US010508851B2

(12) United States Patent
Hong et al.

(10) Patent No.: US 10,508,851 B2
(45) Date of Patent: Dec. 17, 2019

(54) ICE MAKER ASSEMBLY WITH TILTED WATER TANK FOR REFRIGERATOR

(71) Applicant: Samsung Electronics Co., Ltd, Gyeonggi-do (KR)

(72) Inventors: Chang Uo Hong, Gyeonggi-do (KR); Kyoung Ki Park, Gyeonggi-do (KR); Min Seob Yook, Gyeonggi-do (KR); Byeong Soo Kim, Seoul (KR); Hyun-Il Lee, Seoul (KR); Sang Woon Jeon, Seoul (KR); Se Lim Yoon, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 127 days.

(21) Appl. No.: 15/368,537

(22) Filed: Dec. 2, 2016

(65) Prior Publication Data

US 2017/0159986 A1 Jun. 8, 2017

(30) Foreign Application Priority Data

Dec. 4, 2015 (KR) ..... 10-2015-0172559

(51) Int. Cl.
*F25C 1/02* (2006.01)
*F25C 1/04* (2018.01)
(Continued)

(52) U.S. Cl.
CPC ..... *F25C 1/04* (2013.01); *F25C 1/25* (2018.01); *F25C 5/182* (2013.01)

(58) Field of Classification Search
CPC ..... F25C 1/04; F25C 1/25; F25C 5/182
See application file for complete search history.

(56) References Cited

U.S. PATENT DOCUMENTS 2,994,204 A 8/1961 Archer
3,411,554 A 11/1968 Wilson
(Continued)

FOREIGN PATENT DOCUMENTS

CN 101952672 A 1/2011
CN 102538359 B 3/2014
(Continued)

OTHER PUBLICATIONS

Foreign Communication from Related Counterpart Application; European Patent Application No. 16200257.0; Extended European Search Report and European Search Opinion dated May 18, 2017; 7 pages.

(Continued)

*Primary Examiner* — Filip Zec

(57) ABSTRACT

Disclosed herein are an ice maker assembly movably disposed in a storage space, and a refrigerator comprising the same are provided. An ice maker assembly disposed in a storage space of a refrigerator to form ice, the ice maker assembly includes an ice maker unit configured to form ice and a basket unit configured to store the ice formed in the ice maker unit, wherein the ice maker unit includes a frame mounted at the refrigerator, a tray mounted at the frame and having a space in which the ice is formed, a water tank tiltably mounted at the frame and configured to supply water to the tray, and water stored in the water tank is supplied to the tray when the water tank is tilted in one direction.

20 Claims, 31 Drawing Sheets

(51) Int. Cl.
*F25C 5/182* (2018.01)
*F25C 1/25* (2018.01)

(56) References Cited

U.S. PATENT DOCUMENTS

| | | | | | |
|---|---|---|---|---|---|
| 4,265,089 | A * | 5/1981 | Webb | F25C 1/04 280/801.2 |
| 6,112,540 | A * | 9/2000 | Serrels | F25C 1/04 62/351 |
| 7,204,092 | B2 * | 4/2007 | Azcarate Castrellon | F25C 1/04 249/118 |
| 7,934,389 | B2 * | 5/2011 | Yoon | F25C 1/10 62/344 |
| 9,097,451 | B2 | 8/2015 | Lee | |
| 9,175,892 | B2 * | 11/2015 | Saito | F25C 1/24 |
| 9,599,385 | B2 * | 3/2017 | Guarino | F25C 1/24 |
| 2007/0012061 | A1 * | 1/2007 | Ribeiro | F25C 1/22 62/344 |
| 2014/0165623 | A1 | 6/2014 | Guarino et al. | |

FOREIGN PATENT DOCUMENTS

| | | | |
|---|---|---|---|
| DE | 102011006858 | A1 | 10/2012 |
| EP | 3295099 | A1 | 3/2018 |
| JP | 2011-122750 | A | 6/2011 |
| JP | 2015-004488 | A | 1/2015 |
| WO | 2015062667 | A1 | 5/2015 |
| WO | 2017065507 | A1 | 4/2017 |

OTHER PUBLICATIONS

Office Action dated Jan. 2, 2019 in connection with Chinese Patent Application No. 201611101626.7, 40 pages.
European Patent Office, Communication pursuant to Article 94(3) EPC, Application No. EP16200257.0, Jun. 24, 2019, 7 pages.
China National Intellectual Property Administration, "Notification of the Second Office Action," Application No. CN201611101626.7. dated Aug. 21, 2019, 12 pages.

* cited by examiner

ICE MAKER ASSEMBLY WITH TILTED WATER TANK FOR REFRIGERATOR

CROSS-REFERENCE TO RELATED APPLICATION(S) AND CLAIM OF PRIORITY

The present application is related to and claims the benefit of Korean Patent Application No. 10-2015-0172559, filed on Dec. 4, 2015 in the Korean Intellectual Property Office, the disclosure of which is incorporated herein by reference.

TECHNICAL FIELD

The present disclosure relates to an ice maker assembly with an improved structure and a refrigerator having the same.

BACKGROUND

Generally, a refrigerator is a home appliance in which cold air generated in an evaporator is supplied to a freezer compartment and a refrigerator compartment to maintain freshness of various kinds of food for a long time. Food that should be kept at a freezing temperature or lower, e.g., meat, fish, frozen desserts, and the like, is stored in the freezer compartment, and food that should be kept at a temperature higher than the freezing temperature, e.g., vegetables, fruits, beverages, and the like, is stored in the refrigerator compartment.

An ice maker assembly capable of forming ice may be disposed in the freezer compartment. The ice maker assembly may include a tray configured to receive water, a withdrawal device configured to separate ice from the tray, and an ice basket configured to store the ice separated from the tray. The withdrawal device may separate ice from the tray by twisting the tray. The ice basket may be disposed below the tray so that ice separated from the tray may be fall and be accommodated in the tray.

Conventionally, an ice maker assembly is mounted on a shelf inside a freezer compartment. A user detaches a tray, directly supplies water to the tray, and mounts the tray on the shelf inside the freezer compartment. When the water supplied to the tray is frozen and becomes ice, the ice is separated from the tray using a withdrawal device, and the separated ice is stored in an ice basket disposed below the tray.

When the ice maker assembly is mounted on the shelf inside the freezer compartment as described above, a lot of space inside the freezer compartment is occupied by the ice maker assembly such that space utilization is inefficient. In addition, since the user has to directly detach the tray to supply water to the tray, usage is inconvenient.

SUMMARY

To address the above-discussed deficiencies, it is a primary object to provide an ice maker assembly movably disposed in a storage space, and a refrigerator having the same is provided.

Further, according to an embodiment, an ice maker assembly in which water may be supplied to a tray without the tray being detached, and a refrigerator having the same are provided.

Further, according to an embodiment, an ice maker assembly in which a water tank, a tray, and an ice basket are detachably disposed, and a refrigerator having the same are provided.

In accordance with one aspect of the present disclosure, an ice maker assembly disposed in a storage space of a refrigerator to form ice, the ice maker assembly may include an ice maker unit configured to form ice and a basket unit configured to store the ice formed in the ice maker unit, wherein the ice maker unit may include a frame mounted at the refrigerator, a tray mounted at the frame and having a space in which the ice is formed, a water tank tiltably mounted at the frame and configured to supply water to the tray, and water stored in the water tank is supplied to the tray when the water tank is tilted in one direction.

The water tank may be disposed to be detachable from the frame.

The water tank may be disposed to be tiltable about a rotating protrusion integrally formed with the water tank.

A guide protrusion configured to guide a tilting motion of the water tank may be disposed at a side surface of the water tank, and a mounting guide configured to guide movement of the guide protrusion is disposed at the frame.

The mounting guide may include a first accommodator configured such that the guide protrusion is movably inserted therein and a second accommodator configured such that a rotating protrusion is disposed at a side surface of the water tank inserted therein, and the guide protrusion moves along the first accommodator when the rotating protrusion rotates in the second accommodator.

One side of the first accommodator and one side of the second accommodator may be open to enable the guide protrusion accommodated in the first accommodator and the rotating protrusion accommodated in the second accommodator to leave the first accommodator and the second accommodator, respectively.

The first accommodator may include a locking portion configured to interfere with the guide protrusion when the water tank is tilted in the one direction and opened to keep the water tank tilted in the one direction.

The first accommodator may include a seating guide configured to interfere with the guide protrusion when the water tank is tilted in the other direction and closed to prevent the water tank from freely opening.

The seating guide may be provided by a part of a seating portion on which the guide protrusion is movably seated convexly formed upward.

The frame may include a lever connected to the tray and configured to be tiltable, and the tray may rotate about a rotating shaft when the lever is tilted.

The basket unit may include a frame and a basket detachably disposed at the frame, and the basket may be tiltably mounted at the frame.

A guide protrusion may protrude from a side surface of the basket, and the frame may include a mounting guide configured to guide the guide protrusion by the guide protrusion being inserted therein.

One side of the mounting guide may be open to enable the guide protrusion to leave the mounting guide.

The mounting guide may include an interfering protrusion, the guide protrusion may include a locking portion configured such that the interfering protrusion is inserted therein, and the interfering protrusion may be inserted into the locking portion when the basket is mounted at the frame and tilted in the one direction to keep the basket tilted.

One side of the interfering protrusion may interfere with a rotation limiter disposed at the mounting guide when the basket is tilted in the other direction to fix the basket to prevent the basket from moving in the one direction.

In accordance with one aspect of the present disclosure, a refrigerator may include a main body configured to form a storage space therein, a door mounted at the main body to open and close the storage space, an ice maker unit detachably mounted at the door and configured to form ice, and a basket unit detachably mounted at the door and configured to store the ice formed in the ice maker unit, wherein the ice maker unit includes a tray having a space in which the ice is formed and a water tank tilted to supply water to the tray.

A plurality of mounting protrusions may be disposed at an inner surface of the door, the plurality of mounting protrusions may be spaced apart from one another in a vertical direction, and interferers configured to interfere with the mounting protrusions may be disposed at a side surface of the ice maker unit and a side surface of the basket unit.

Positions at which the ice maker unit and the basket unit may be mounted at the door are changeable in the vertical direction.

The ice maker unit may include a frame detachably mounted at the door, and the water tank and the tray may be tiltably mounted at the frame.

The frame may include an accommodator configured to accommodate water supplied from the water tank, a hole through which water is discharged may be formed at a bottom surface of the accommodator, and the bottom surface may be inclined to enable water introduced into the accommodator to flow toward the hole.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 30, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device.

Hereinafter, an ice maker assembly and a refrigerator having the same according to an embodiment will be described in detail with reference to the drawings.

Figure 1:
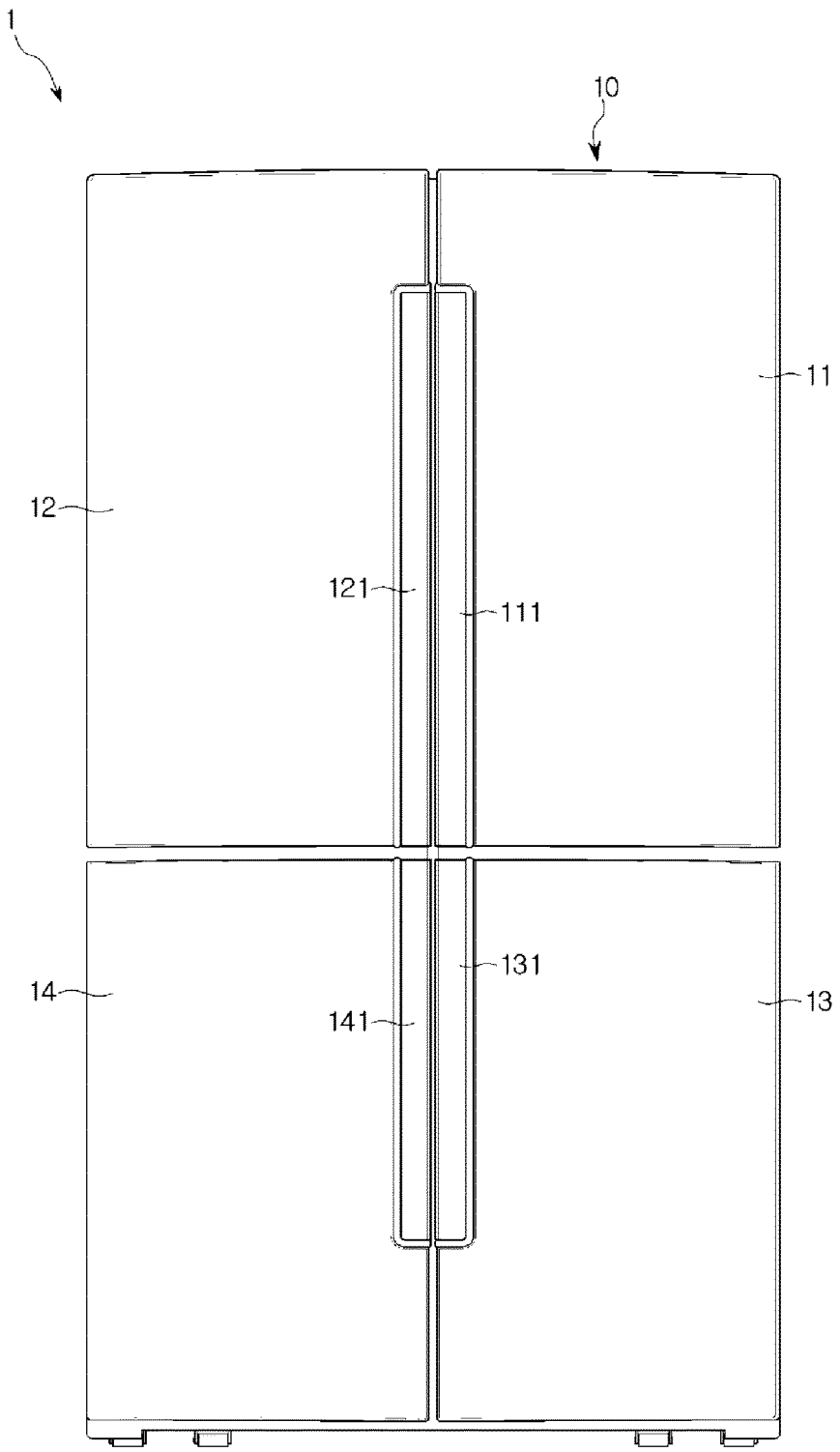
FIG. 1 illustrates a front view for a refrigerator according to various embodiments of the present disclosure.
Figure 2:
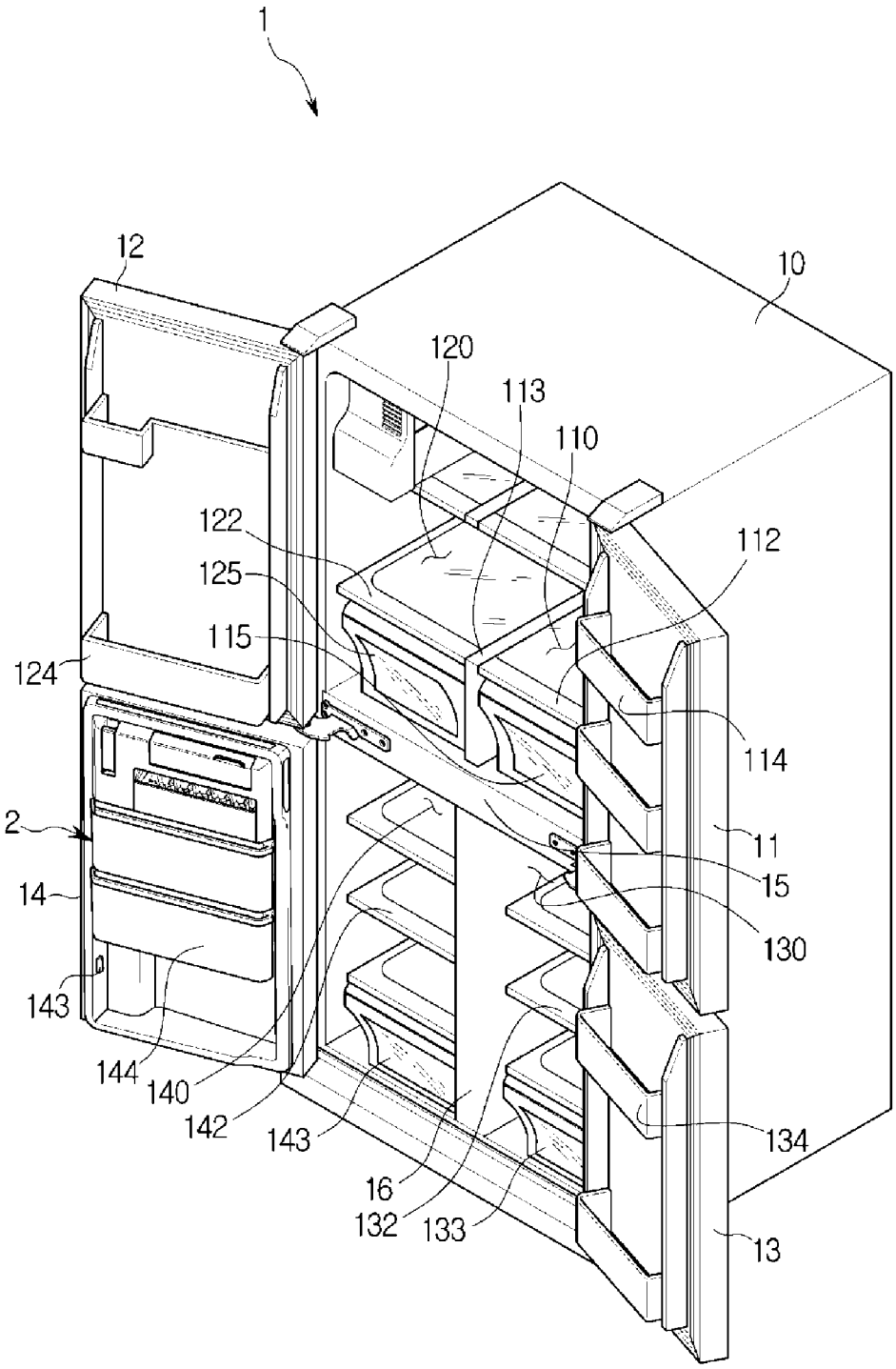
FIG. 2 illustrates a view for an interior of the refrigerator according to various embodiments or the present disclosure.

FIG. 1 illustrates a front view for a refrigerator according to various embodiments of the present disclosure, and FIG. 2 illustrates a view for an interior of the refrigerator according to various embodiments of the present disclosure.

Referring to FIGS. 1 and 2, a refrigerator 1 according to an embodiment may include a food storage space, a main body 10 having an opening formed on at least one side, and doors 11, 12, 13, and 14 configured to open and close the opening. The doors 11, 12, 13, and 14 may respectively include handles 111, 121, 131, and 141 configured to facilitate opening and closing of the doors 11, 12, 13, and 14. The doors 11, 12, 13, and 14 may be rotary doors disposed to be rotatable about a hinge. One or more of the doors 11, 12, 13, and 14 may be a drawer-type door connected to a basket configured to store food therein. Hereinafter, an embodiment in which the doors 11, 12, 13, and 14 are rotary doors will be described.

A partition 15 may be transversely disposed inside the main body 10. An inner space of the main body 10 may be divided by the partition 15 into a refrigerator compartment and a freezer compartment. For example, upper storage spaces 110 and 120 provided by the partition 15 may be refrigerator compartments, and lower storage compartments 130 and 140 may be freezer compartments.

Hereinafter, an embodiment in which the upper storage spaces 110 and 120 are disposed as refrigerator compartments and the lower storage spaces 130 and 140 are disposed as freezer compartments will be described.

The upper storage spaces 110 and 120 may be opened and closed by a first door 11 and a second door 12, respectively. The upper storage spaces 110 and 120 may include a first upper storage space 110 opened and closed by the first door 11 and a second upper storage space 120 opened and closed by a second door 12. The first upper storage space 110 and the second upper storage space 120 may be disposed as a single integrated space.

Portions of the upper storage spaces 110 and 120 may be divided as the first upper storage space 110 and the second upper storage space 120 by a sidewall 113. Shelves 112 and 122 may be easily installed using the sidewall 113 and inner surfaces of the upper storage spaces 110 and 120. The shelves 112 and 122 may be disposed to be moveable. Baskets 115 and 125 may be drawably disposed in the upper storage spaces 110 and 120.

Baskets 114 and 124 configured to store food may be mounted at inner surfaces of the first door 11 and the second door 12, respectively. A plurality of baskets 114 and 124 may be disposed, and the baskets 114 and 124 may be disposed to be movable according to user convenience.

The lower storage spaces 130 and 140 may include a first lower storage space 130 and a second lower storage space 140 divided by a partition 16. The first lower storage space 130 may be opened and closed by a third door 13, and the second lower storage space 140 may be opened and closed by a fourth door 14.

Shelves 132 and 142 may be respectively disposed at the first lower storage space 130 and the second lower storage space 140 to have food placed thereon. Baskets 133 and 143 may be respectively disposed in the first lower storage space 130 and the second lower storage space 140 to have food stored therein.

Baskets 134 and 144 configured to store food may be mounted at inner surfaces of the third door 13 and the fourth door 14, respectively. A plurality of baskets 134 and 144 may be disposed, and the baskets 134 and 144 may be disposed to be movable according to user convenience.

An ice maker assembly 2 may be mounted at the inner surface of at least one of the third door 13 and the fourth door 14. For example, the ice maker assembly 2 may be mounted at the inner surface of the fourth door 14. Similar to the baskets 144 mounted at the inner surface of the fourth door 14, the ice maker assembly 2 may be disposed to be movable according to user convenience.

Hereinafter, an embodiment in which the ice maker assembly 2 is mounted at the fourth door 14 will be described.

Figure 3A:
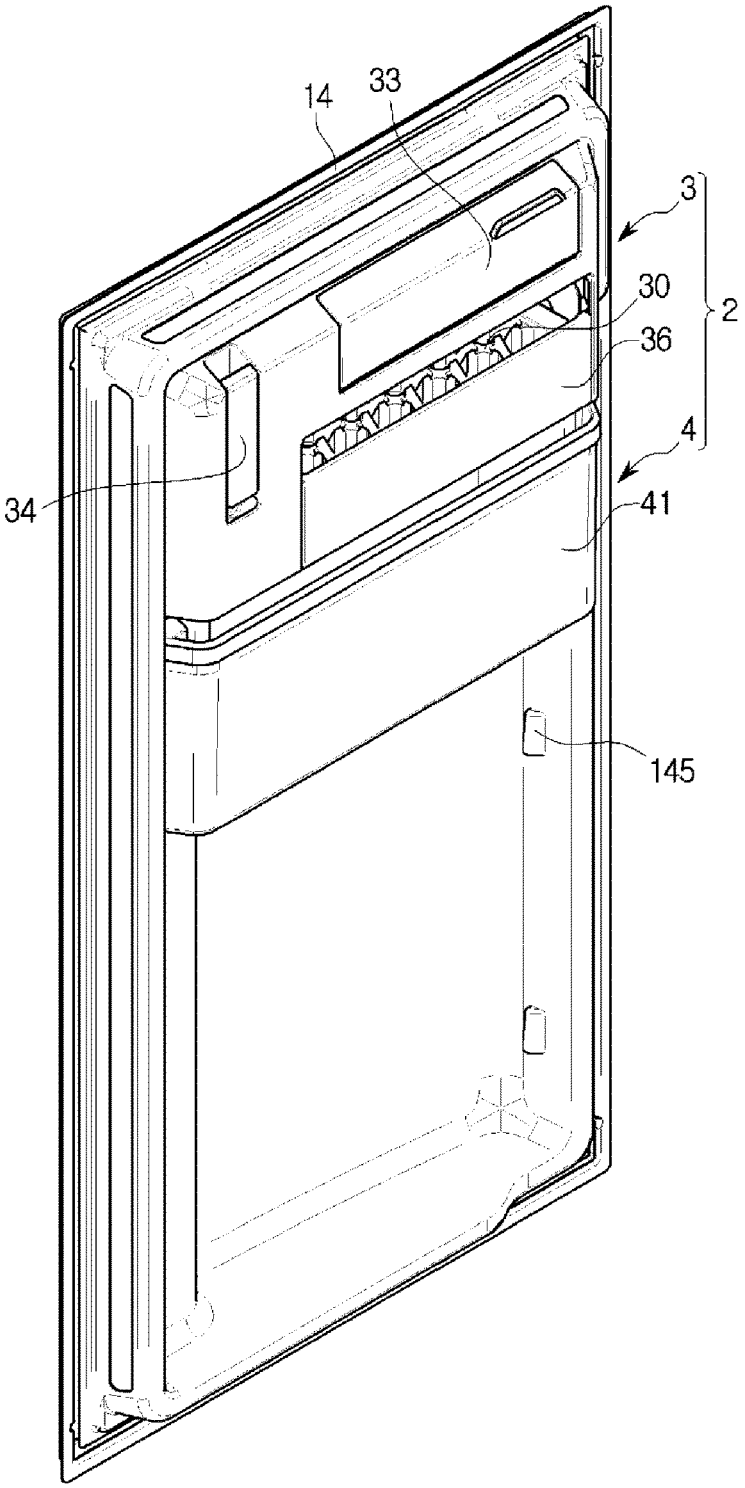
FIGS. 3*a* and 3*b* illustrate views for a state in which an ice maker assembly is installed at a door of the refrigerator according to various embodiments of the present disclosure.
Figure 3B:
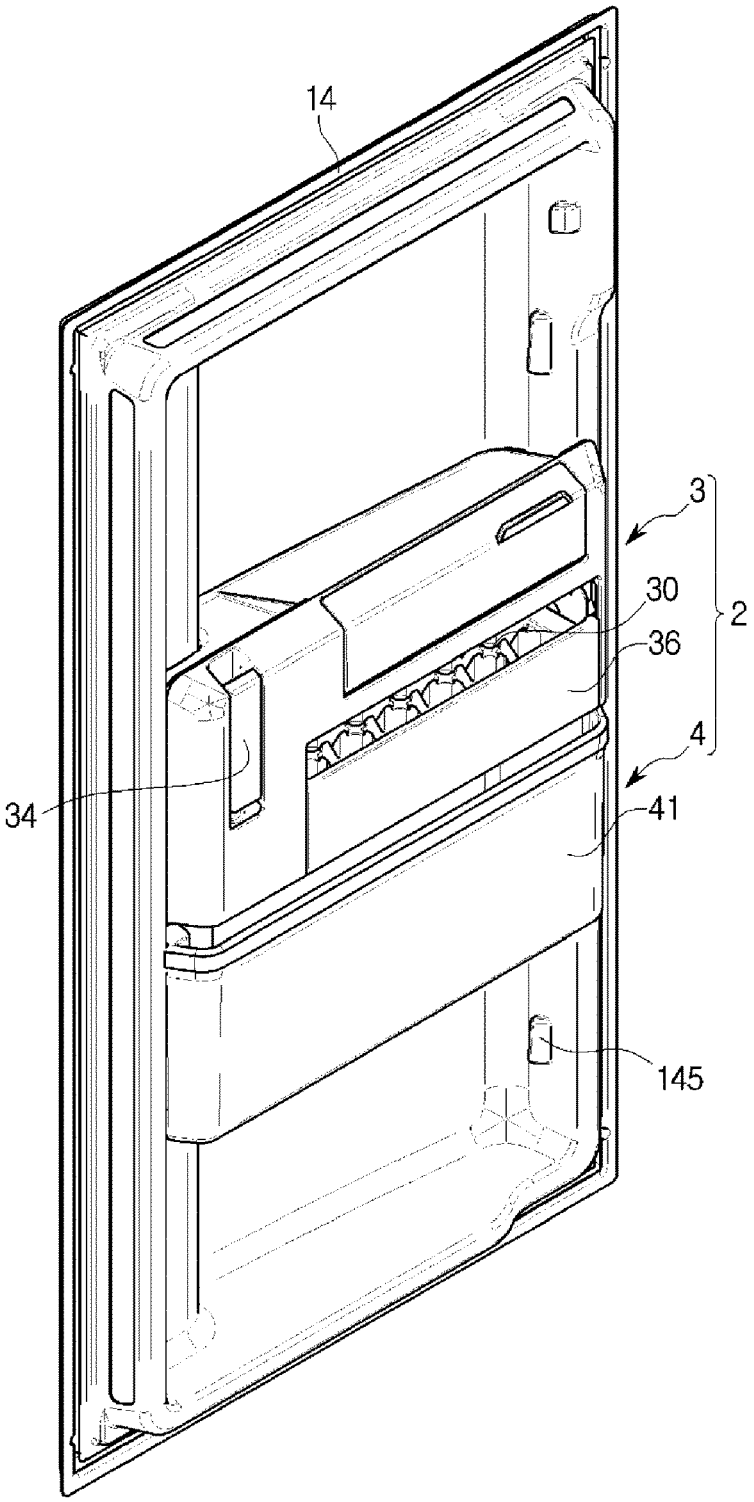

FIGS. 3A and 3B illustrate views for a state in which an ice maker assembly is installed at a door of the refrigerator according to various embodiments of the present disclosure.

Referring to FIGS. 3A and 3B, the ice maker assembly 2 may be mounted at the fourth door 14 of the refrigerator according to various embodiments of the present disclosure. The ice maker assembly 2 may include an ice maker unit 3 and a basket unit 4. Ice may be formed in the ice maker unit 3. The ice formed in the ice maker unit 3 may be stored in the basket unit 4. The basket unit 4 may be disposed below the ice maker unit 3.

A plurality of mounting protrusions 145 may protrude from the inner surface of the fourth door 14. The plurality of mounting protrusions 145 may be disposed to be spaced a predetermined distance apart in a vertical direction.

The ice maker assembly 2 may be mounted at the inner surface of the fourth door 14 by interferers 317 and 402 (refer to FIGS. 4 and 16) disposed at side surfaces thereof and interfering with the mounting protrusions 145. An interferer may also be disposed at a side surface of the basket 144 mounted at the fourth door 14, and the interferer may also be disposed to interfere with the mounting protrusion 145.

A user may detach the ice maker assembly 2 from the fourth door 14 by releasing interference between the interferers 317 and 402 of the ice maker assembly 2 and the mounting protrusions 145. The user may detach the ice maker assembly 2 to mount the ice maker assembly 2 on the mounting protrusion 145 disposed at an upper portion of the fourth door 14 or on the mounting protrusion 145 disposed at a lower portion of the fourth door 14. In this way, the user may conveniently change a mounting position of the ice maker assembly 2. Here, the basket unit 4 may be disposed below the ice maker unit 3 so that ice formed by the ice maker unit 3 may fall and be stored in the basket unit 4.

Figure 4:
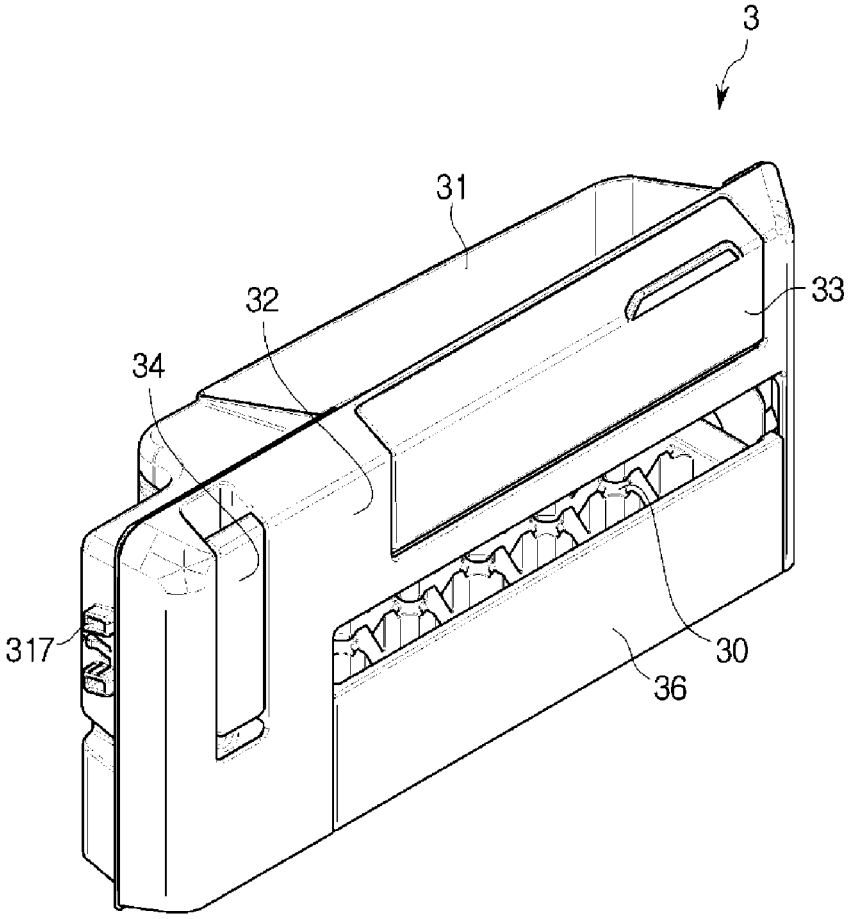
FIG. 4 illustrates a view for an ice maker unit according to various embodiments of the present disclosure.
Figure 5:
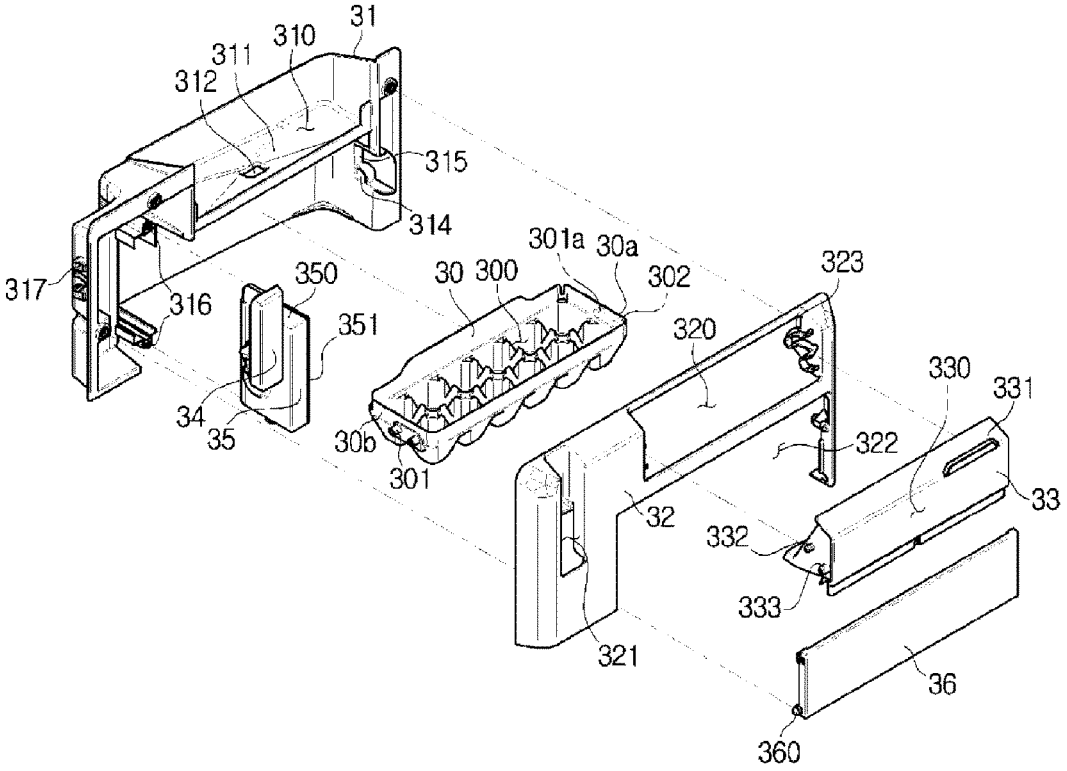
FIG. 5 illustrates an exploded perspective view for the ice maker unit according to various embodiments of the present disclosure

FIG. 4 illustrates a view for an ice maker unit according to various embodiments of the present disclosure, and FIG. 5 illustrates an exploded perspective view for the ice maker unit according to various embodiments of the present disclosure.

Referring to FIGS. 4 and 5, the ice maker unit 3 according to an embodiment may include a tray 30 configured to receive water to form ice, frames 31 and 32 configured to mount the tray 30, and a water tank 33 configured to supply water to the tray 30.

The frames 31 and 32 may include a first frame 31 mounted at the fourth door 14 and a second frame 32 mounted in front of the first frame 31. The tray 30 may be mounted at the first frame 31. The water tank 33 may be tiltably mounted at the second frame 32. The tray 30 and the water tank 33 may be detachably mounted at the first frame 31 and the second frame 32, respectively.

A lever 34 may be further disposed at any one of the first frame 31 and the second frame 32. For example, the lever 34 may be mounted at the second frame 32. The lever 34 may be connected to the tray 30 by a connector 35. The lever 34 may be tiltably disposed, and the user may tilt the lever 34 to separate ice from the tray 30. The ice separated from the tray 30 may fall and be stored in the basket unit 4 disposed below the ice maker unit 3.

The interferer 317 configured to interfere with the mounting protrusion 145 of the fourth door 14 may protrude from one side of the first frame 31. The ice maker unit 3 may be mounted at the fourth door 14 by the interferer 317 interfering with the mounting protrusion 145. The user may detach the ice maker unit 3 from the fourth door 14 by releasing interference between the interferer 317 and the mounting protrusion 145.

An accommodator 310, which is a space into which water of the water tank 33 is introduced, may be disposed at the first frame 31. Water may be supplied to the water tank 33, and the water accommodated in the water tank 33 may be introduced into the accommodator 310 when the water tank 33 is tilted.

A hole 312 may be formed at a bottom surface 311 of the first frame 31 forming the accommodator 310. Water supplied to the accommodator 310 may be discharged through the hole 312 and supplied to the tray 30. The water supplied to the accommodator 310 may be discharged through the hole 312 and introduced into the tray 30 disposed below the accommodator 310.

The bottom surface 311 of the first frame 31 may be formed to be slanted. The hole 312 may be formed at the lowest portion of the bottom surface 311. The water supplied to the accommodator 310 may be guided by the slanted bottom surface 311 to be discharged through the hole 312.

A tray accommodation space 313 configured to accommodate the tray 30 may be provided below the bottom surface 311. A mount 314 configured such that the tray 30 is rotatably mounted thereon may be disposed at a side surface of the first frame 31 forming the tray accommodation space 313. A rotating shaft 301*a* disposed at one side of the tray 30 may be mounted at the mount 314. The mount 314 may be provided in the form of a hole or a groove so that the rotating shaft 301*a* disposed at the one side of the tray 30 is rotatably inserted therein. A rotating shaft 301 disposed at the other side of the tray 30 may be mounted at the connector 35 connected to the lever 34.

A stopper 315 may be disposed at a side surface of the first frame 31 to interfere with an interfering protrusion 302 disposed at one side of the tray 30. The stopper 315 may be stepped to interfere with the one side of the tray 30 to prevent the one side of the tray 30 from rotating by a predetermined angle or larger.

A fastener 316 configured such that a fastening member passes therethrough may be disposed at the first frame 31 so that the second frame 32 is mounted thereto.

A first opening 320 may be formed at a front portion of the second frame 32 to enable the water tank 33 to be mounted and water in the water tank 33 to be supplied to the accommodator 310. A mounting guide 323 configured to guide a guide protrusion 332 to enable the water tank 33 to be tilted may be disposed at a side surface of the second frame 32 forming the first opening 320. A detailed configuration of the mounting guide 323 will be described below. The water tank 33 may be tiltably mounted at the second frame 32 and may be disposed to be detachable from the second frame 32 when necessary.

The lever 34 may be mounted at one side of the second frame 32. A lever accommodator 321 configured to accommodate the lever 34 may be disposed at the second frame 32 to enable front surfaces of the lever 34 and the second frame 32 to form the same flat surface.

A second opening 322 configured to enable the tray 30 to be inserted and withdrawn may be disposed at the second frame 32. The second opening 322 may be disposed below the first opening 320.

The water tank 33 may be tiltably mounted at the second frame 32. A rotating protrusion 333 disposed to be rotatable and inserted into one side of the mounting guide 323 disposed at the second frame 32, and the guide protrusion 332 guided by the mounting guide 323 may be included at a side surface of the water tank 33. The water tank 33 may be stably tilted by the guide protrusion 332 moving along the mounting guide 323. The rotating protrusion 333 and the mounting guide 323 may be integrally injection-molded with the water tank 33.

The water tank 33 may be detachably mounted at the second frame 32. Consequently, the user may detach the water tank 33 from the second frame 32 as necessary. For example, when the water tank 33 needs to be cleaned, the water tank 33 may be detached from the ice maker unit 3 to be cleaned.

A handle 331 may be disposed at one side of the water tank 33 to enable the user to easily tilt the water tank 33 while holding the handle 331.

An ice making portion 300, which is a space in which water is accommodated and ice is formed, may be disposed in the tray 30. The rotating shafts 301*a* and 301 may be disposed at side surfaces of the tray 30. The rotating shafts 301*a* and 301 may protrude from the side surfaces of the tray 30.

The rotating shaft 301*a* disposed at the one side surface of the tray 30 may be rotatably mounted at the mount 314 of the first frame 31. The rotating shaft 301 disposed at the other side surface of the tray 30 may be connected to the lever 34. The rotating shaft 301 may be connected to the lever 34 by the connector 35. Detailed configurations of the lever 34 and the connector 35 will be described below.

The interfering protrusion 302 configured to interfere with the stopper 315 may protrude from the side surface of the tray 30. The interfering protrusion 302 may only be formed at one side surface of the tray 30. The lever 34 may be connected to the rotating shaft 301 disposed at the other side surface of the tray 30, and the tray 30 may rotate when the lever 34 is tilted by the user. After the tray 30 rotates by the predetermined angle, rotation of one side of the tray 30 is limited by the interfering protrusion 302 interfering with the stopper 315. However, the other side of the tray 30 may rotate more than the one side of the tray 30 due to the lever 34 and cause the tray 30 to be twisted. The tray 30 is twisted, and ice accommodated in the ice making portion 300 may be separated from the ice making portion 300. The ice separated from the tray 30 may fall and be accommodated in the basket unit 4 disposed below the tray 30.

Meanwhile, the rotating shafts 301*a* and 301 and the interfering protrusion 302 of the tray 30 may be integrally injection-molded with the tray 30.

The rotating shaft 301 disposed at the other side of the tray 30 may be connected to the lever 34 by the connector 35. The user may tilt the lever 34 to rotate the tray 30 about the rotating shaft 301.

The connector 35 may include housings 350 and 351 and gears 352 and 353 disposed in the housings 350 and 351. The gears 352 and 353 may include a first gear 352 connected to the lever 34 and a second gear 353 connected to the rotating shaft 301 of the tray 30. The second gear 353 may be engaged with the first gear 352.

When the lever 34 is tilted, the first gear 352 may rotate with the lever 34. When the first gear 352 rotates in one direction, the second gear 353 may rotate in the other direction. When the second gear 353 rotates, the tray 30 mounted at the second gear 353 may rotate with the second gear 353.

The rotating shaft 301 disposed at the other side surface of the tray 30 may be inserted into a rotating shaft insertion hole 353*a* disposed at the second gear 353. The rotating shaft 301*a* disposed at the one side surface of the tray 30 may be detachably mounted at the mount 314 disposed at the first frame 31, and the rotating shaft 301 disposed at the other side surface of the tray 30 may be detachably mounted at the rotating shaft insertion hole 353*a*.

The user may detach the tray 30 from the ice maker unit 3 as necessary. For example, when the tray 30 needs to be cleaned, the user may easily detach the tray 30 from the ice maker unit 3 to clean the tray 30. The user may detach the tray 30 from the ice maker unit 3 and withdraw the tray 30 to the front of the second frame 32 through the second opening 322 formed at the second frame 32.

The water tank 33 and the tray 30 are detachably mounted at the ice maker unit 3 as described above such that the ice maker unit 3 may be sanitarily managed.

A cover 36 may be mounted at the second opening 322 formed at the second frame 32. The cover 36 is disposed to open and close the second opening 322. For example, the cover 36 may be disposed to be tiltable about a hinge shaft 360. The user may open the cover 36 to mount the tray 30 at the first frame 31 or detach the tray 30 from the first frame 31 through the second opening 322.

Figure 6:
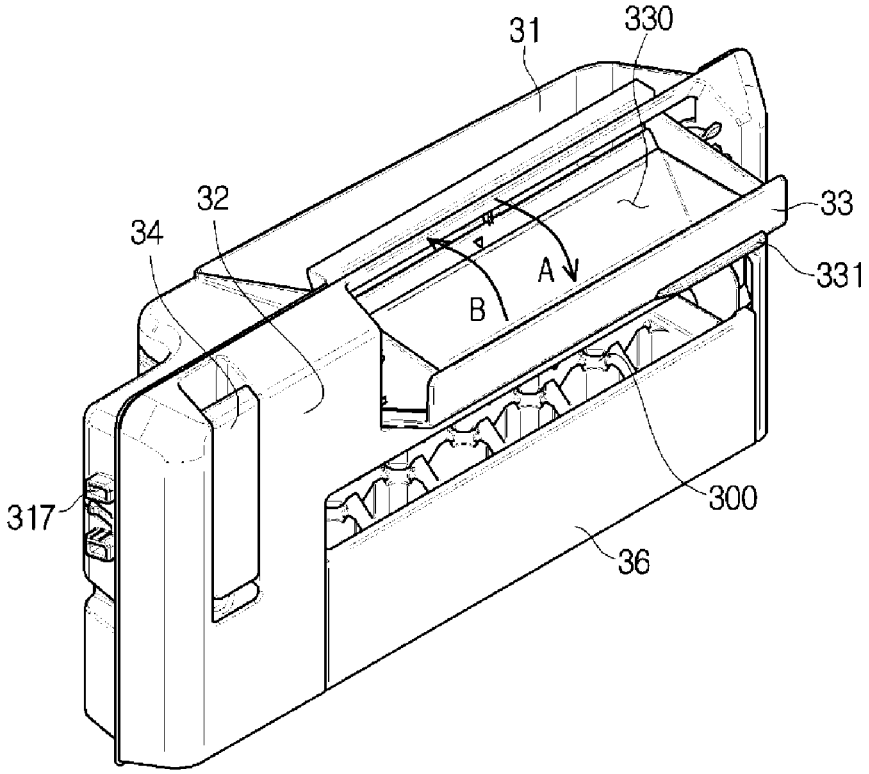
FIG. 6 illustrates a view for a portion of the ice maker unit according to various embodiments of the present disclosure.
Figure 7:
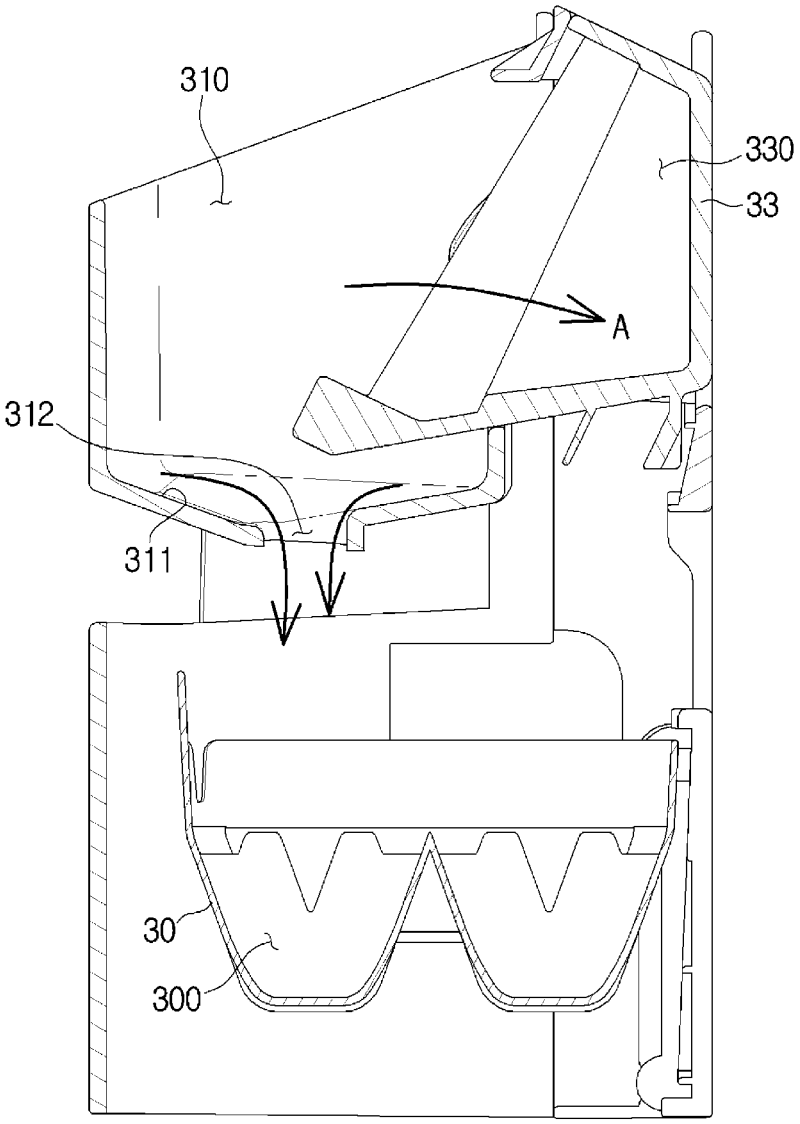
FIG. 7 illustrates a lateral cross-sectional view for the ice maker unit according to various embodiments of the present disclosure.

FIG. 6 illustrates a view for a portion of the ice maker unit according to various embodiments, and FIG. 7 illustrates a lateral cross-sectional view for the ice maker unit according to various embodiments.

Referring to FIGS. 6 and 7, the water tank 33 disposed at the ice maker unit 3, according to various embodiments, may be tilted. The user may supply water to the tray 30 using the water tank 33. The water tank 33 may be disposed to be tilted about the rotating protrusion 333.

The accommodator 310 formed at the first frame 31 may be normally closed by the water tank 33. The user may tilt the water tank 33 to open the accommodator 310 when it is necessary to supply water to the tray 30.

An indication line (not illustrated) may be present on the water tank 33 such that an adequate amount of water may be supplied to the tray 30. The user may supply water up to the indication line on the water tank 33 in one direction A.

After an adequate amount of water is supplied to the water tank 33, the water tank 33 may be tilted in the other direction B. When the water tank 33 is tilted in the other direction B, water in the water tank 33 may be introduced into the accommodator 310 and discharged through the hole 312 formed at the bottom surface 311. The water discharged through the hole 312 may be supplied to the tray 30.

In this way, the user may easily supply an adequate amount of water to the tray 30 using the water tank 33 disposed at the ice maker unit 3.

Figure 8:
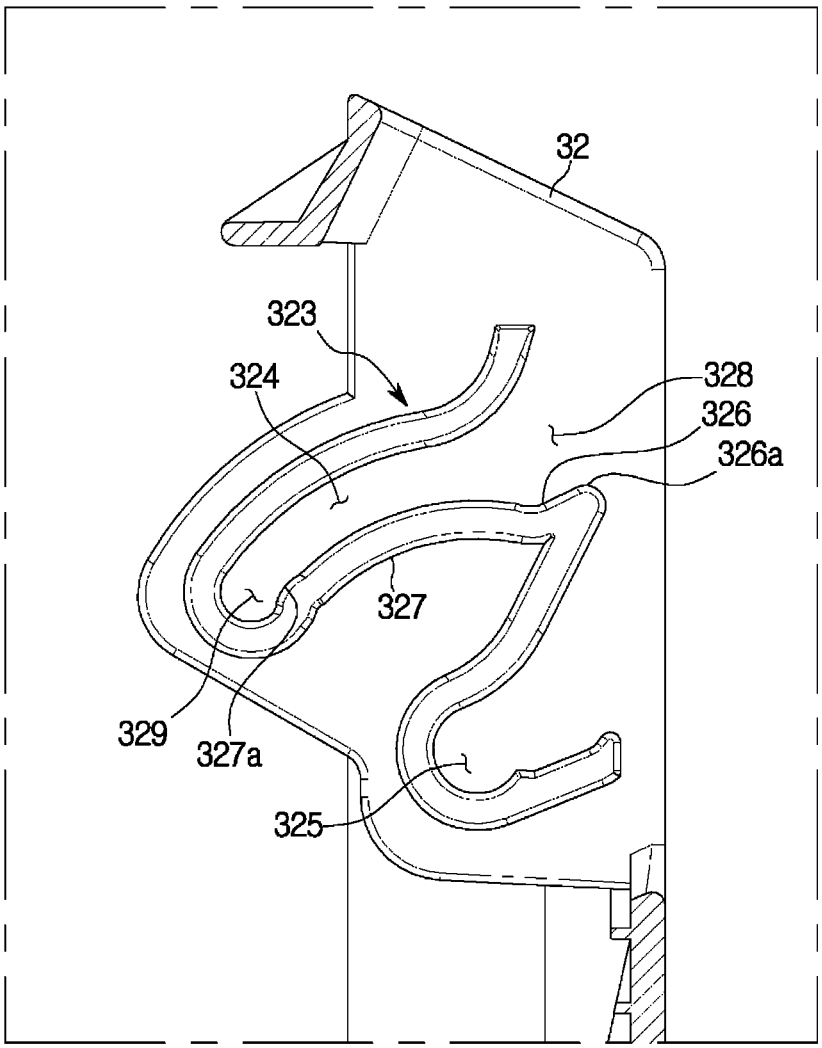
FIG. 8 illustrates a view for a mounting guide of the ice maker unit according to various embodiments of the present disclosure.
Figure 9:
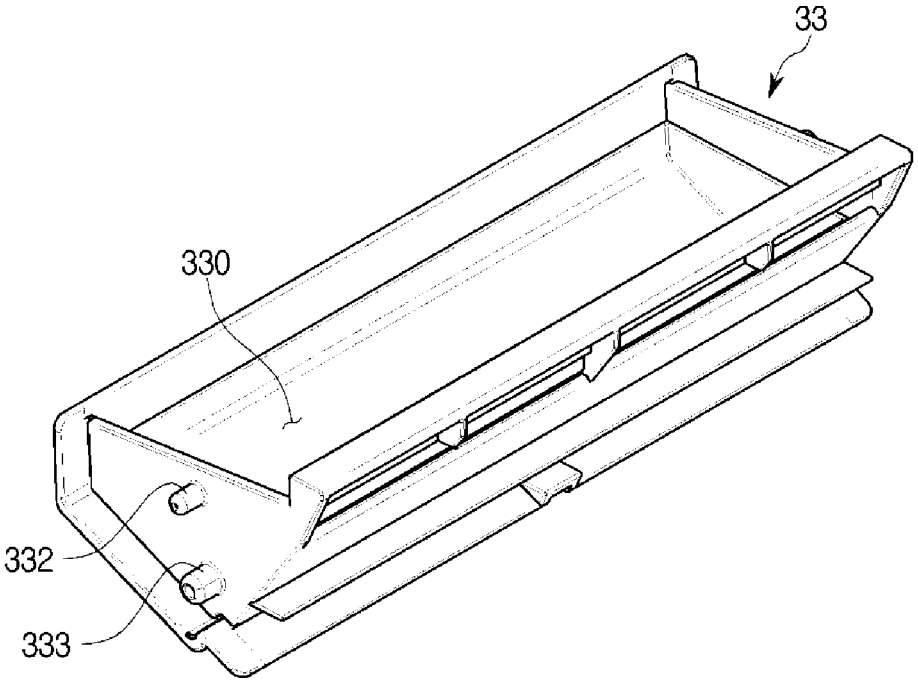
FIG. 9 illustrates a view for a water tank which is mounted at the ice maker unit according to various embodiments of the present disclosure.
Figure 10:
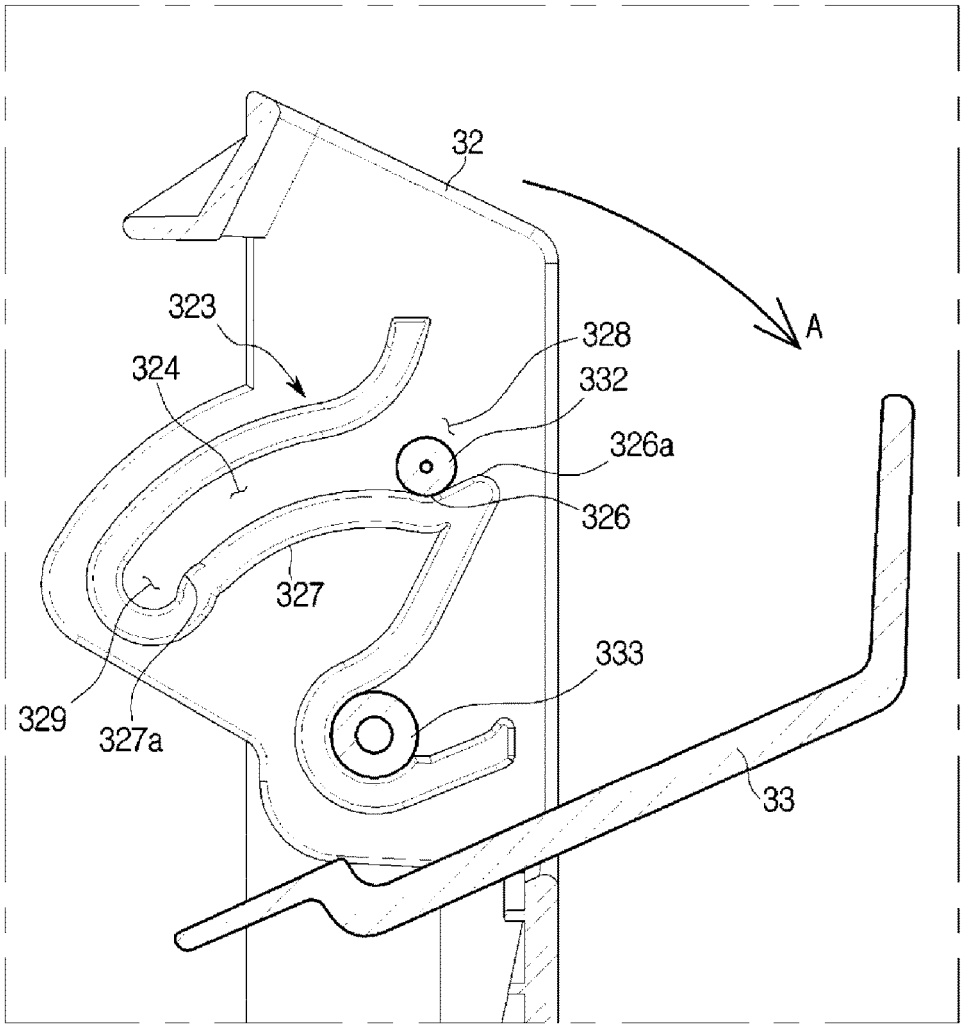
FIGS. 10 and 11 illustrate views for a state in which a guide protrusion of the water tank is guide by the mounting guide according to various embodiments of the present disclosure.
Figure 11:
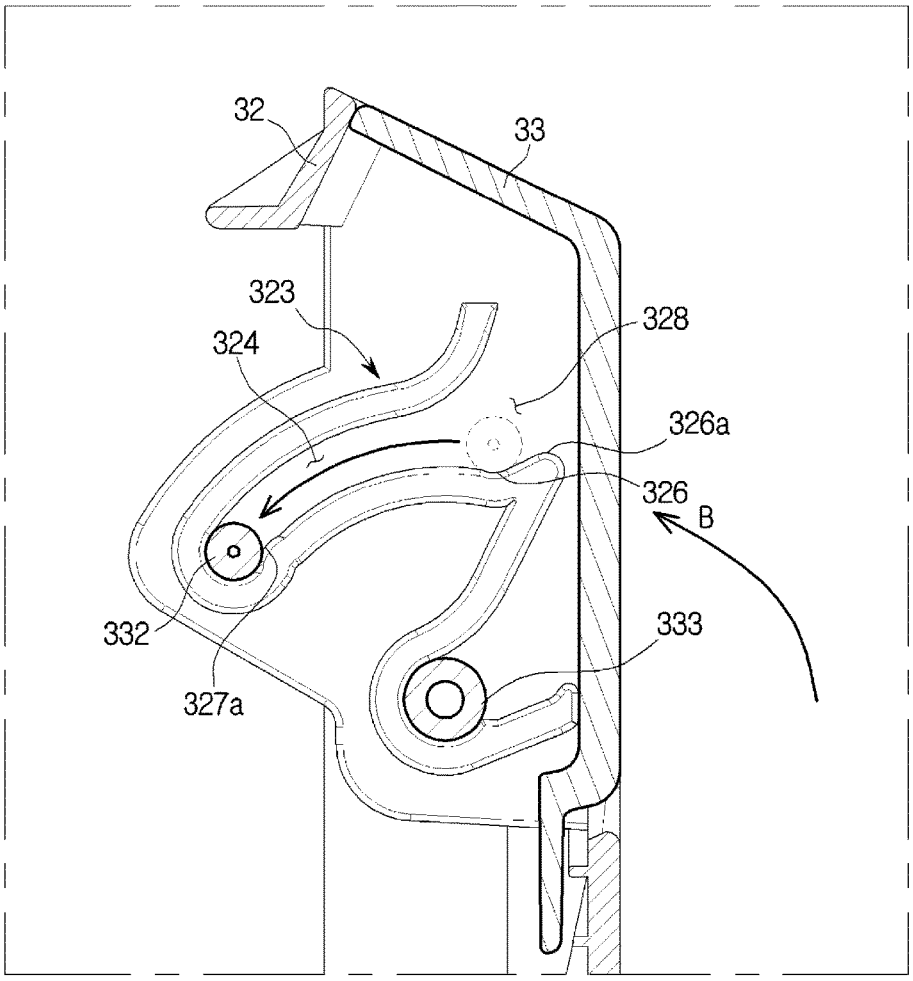

FIG. 8 illustrates a view for a mounting guide of the ice maker unit according to various embodiments, FIG. 9 illustrates a view for a water tank which is mounted at the ice maker unit according to various embodiments, and FIGS. 10 and 11 illustrate views for a state in which a guide protrusion of the water tank, according to various embodiments, is guided by the mounting guide.

Referring to FIGS. 8 to 11, the water tank 33 may be tiltably and detachably mounted at the second frame 32 according to various embodiments. The rotating protrusion 333 disposed at the water tank 33 may be rotatably mounted at the second frame 32, and the second frame 32 may include the mounting guide 323 configured to guide movement of the guide protrusion 332. The water tank 33 may be stably tilted by the guide protrusion 332 moving along the mounting guide 323.

The mounting guide 323 may be disposed in the form of a bent rib. The mounting guide 323 may include a first accommodator 324 configured such that the guide protrusion 332 is movably inserted therein and a second accommodator 325 configured to such that the rotating protrusion 333 is inserted therein.

Each of the first accommodator 324 and the second accommodator 325 may have one open side. The guide protrusion 332 and the rotating protrusion 333 may enter and exit the first accommodator 324 and the second accommodator 325 through the open one side. In this way, the water tank 33 may be detachably mounted at the second frame 32.

The rotating protrusion 333 inserted into the second accommodator 325 may be disposed to rotate at the same place and not move linearly. The first accommodator 324 may be formed to correspond to a moving path of the guide protrusion 332 when the water tank 33 rotates about the rotating protrusion 333. That is, the first accommodator 324 may be disposed to have a longer path than the second accommodator 325.

Meanwhile, the first accommodator 324 and the second accommodator 325 may be formed by bending a single unbroken rib.

When a portion on which the guide protrusion 332 movably inserted into the first accommodator 324 is seated at the mounting guide 323 is referred to as a seating guide 327, a first seating portion 326 bent concavely downward may be disposed at the seating guide 327 disposed near an inlet 328 of the first accommodator 324. The seating guide 327 disposed at the first seating portion 326 may interfere with a locking portion 326*a* disposed near the inlet 328 and be prevented from freely leaving the first accommodator 324.

When the water tank 33 is tilted in the one direction A and opened, the guide protrusion 332 may be disposed at the first seating portion 326 and may interfere with the locking portion 326*a* such that the water tank 33 may remain tilted.

When the water tank 33 is tilted in the other direction B and closed, the guide protrusion 332 may be disposed at a second seating portion 329 disposed at an inner portion of the first accommodator 324. The second seating portion 329 may be formed by bending the seating guide 327 concavely downward. That is, when the water tank 33 is tilted in the other direction B, the guide protrusion 332 may move along the seating guide 327, and when the guide protrusion 332 is disposed at the second seating portion 329, the guide protrusion 332 may be prevented from freely leaving the second seating portion 329 by a seating guide 327*a* which is formed convexly upward directly in front of the second seating portion 329.

Because the guide protrusion 332 is prevented from freely leaving the first seating portion 326 as described above, the water tank 33 may remain attached to the second frame 32 while opened as long as an external force is not applied thereto. Because the guide protrusion 332 is prevented from leaving the second seating portion 329, the water tank 33 may remain closed as long as an external force is not applied thereto.

Accordingly, since additional parts other than the water tank 33 and the second frame 32 are not required to realize a tiltable structure of the water tank 33, manufacturing costs for producing additional parts may be saved. Also, since a process for assembling additional parts may be omitted, production efficiency may be improved.

Also, because the water tank 33 is tiltably disposed at the ice maker unit 3, an adequate amount of water may be easily supplied to the tray 30 without connecting an additional element or detaching the tray 30 to supply water to the tray 30.

Also, since the water tank 33 is detachably disposed at the second frame 32, the water tank 33 may be easily cleaned after being detached from the second frame 32. Thus, the water tank 33 may be sanitarily managed.

Figure 12:
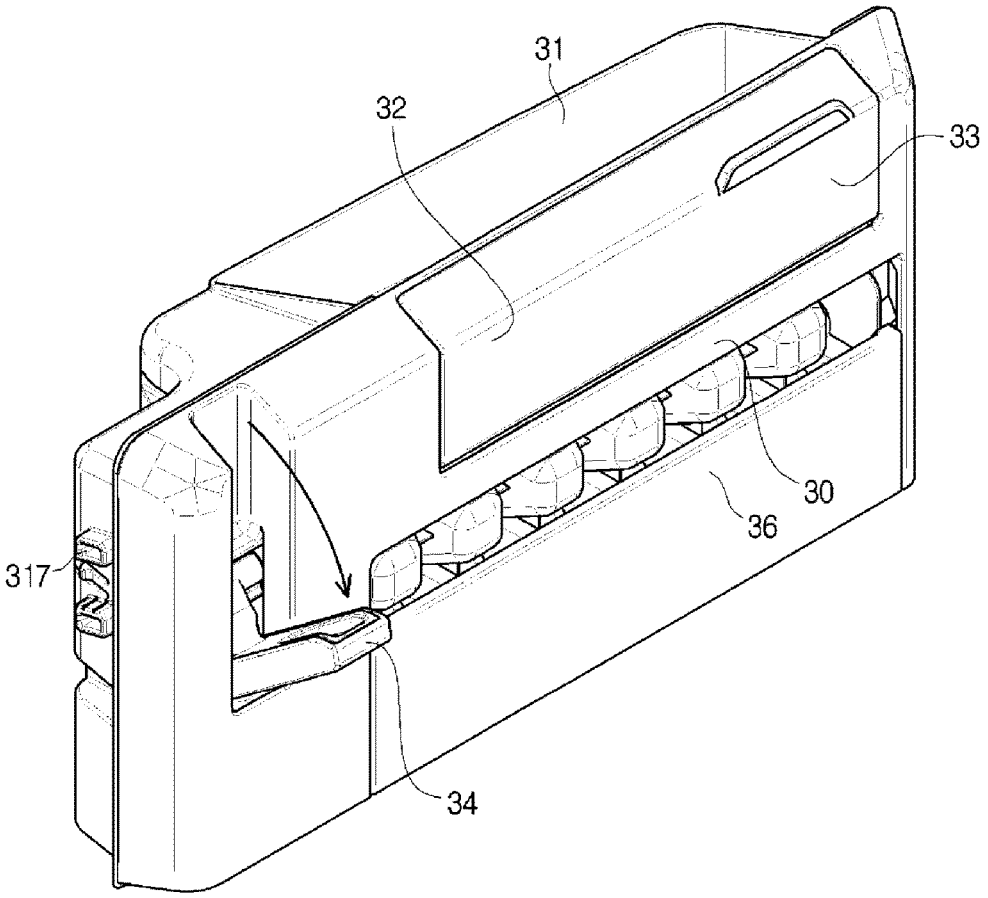
FIG. 12 illustrates a view for a state in which a lever of the ice maker unit is tilted according to various embodiments of the present disclosure.
Figure 13:
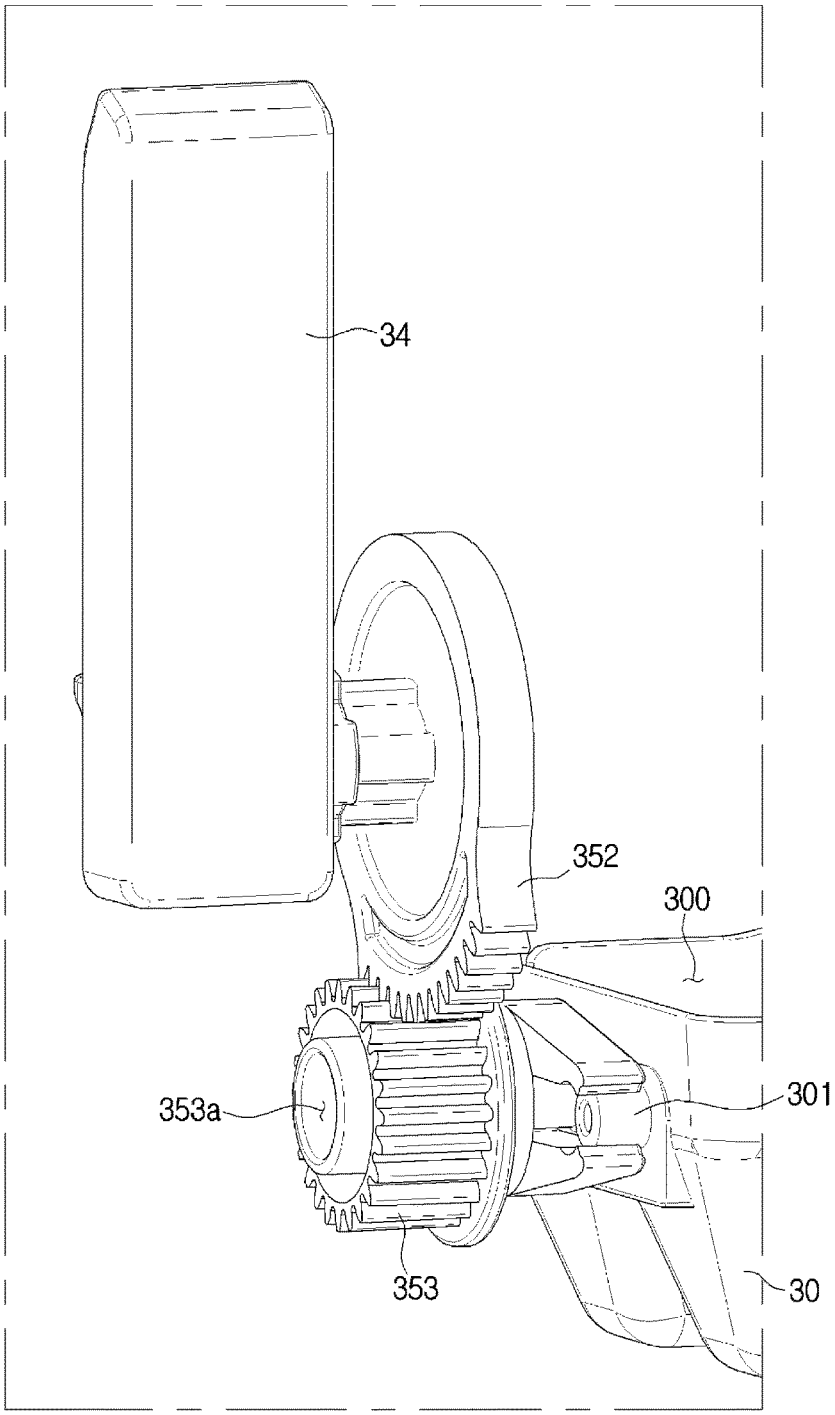
FIG. 13 illustrates a view for a connector between the lever and the tray according to various embodiments of the present disclosure.
Figure 14:
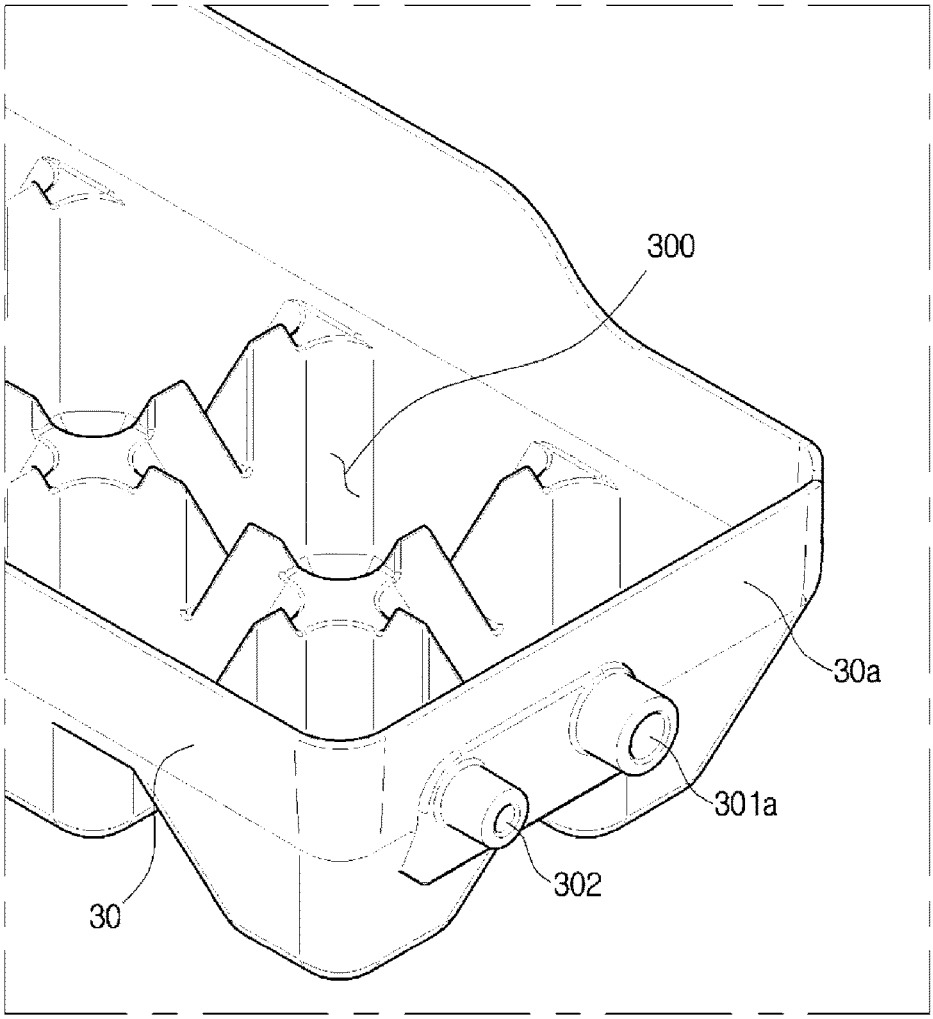
FIG. 14 illustrates a view for a portion of the tray according to various embodiments of the present disclosure.
Figure 15:
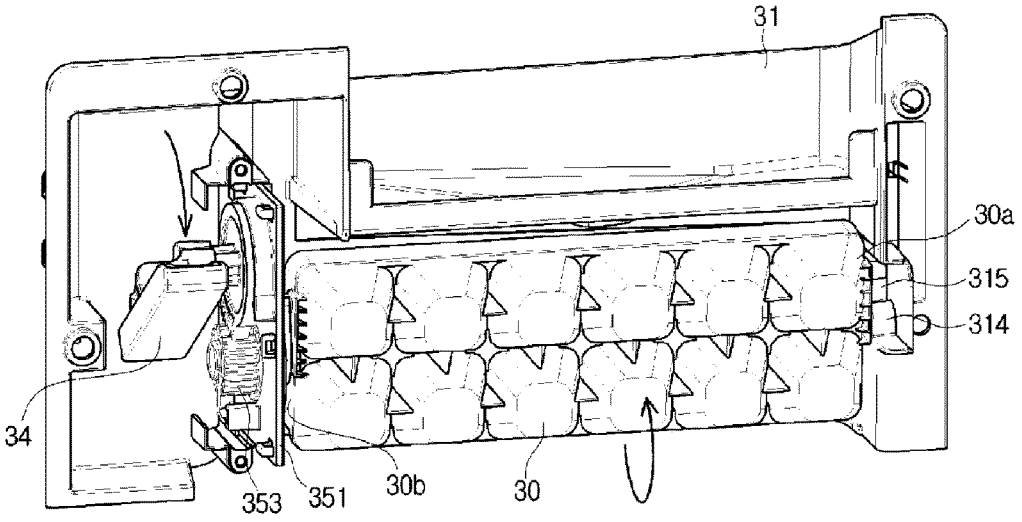
FIG. 15 illustrates a view for a state in which the tray is rotated according to various embodiments of the present disclosure.

FIG. 12 illustrates a view for a state in which a lever of the ice maker unit is tilted according to various embodiments, FIG. 13 illustrates a view for a connector between the lever and the tray according to various embodiments, FIG. 14 illustrates a view for a portion of the tray according to various embodiments, and FIG. 15 illustrates a view for a state in which the tray is rotated according to various embodiments.

Referring to FIGS. 12 to 15, the ice maker unit 3, according to various embodiments, may include the lever 34 connected to the tray 30 to rotate the tray 30. The lever 34 may be tiltably mounted at the second frame 32. The user may tilt the lever 34 in one direction to separate ice from the tray 30. When the lever 34 is tilted in the one direction, the tray 30 may rotate. The tray 30 rotates by the predetermined angle and is then twisted, thereby enabling ice in the tray 30 to be separated from the tray 30.

The rotating shaft 301*a* and the interfering protrusion 302 spaced a predetermined distance apart from the rotating shaft 301*a* may be disposed at one side surface 30*a* of the tray 30. When the tray 30 rotates by the predetermined angle, the interfering protrusion 302 may interfere with the stopper 315 disposed at an inner surface of the first frame 31.

The rotating shaft 301 may be disposed at the other side surface 30*b* of the tray 30. The rotating shaft 301 disposed at the other side surface 30*b* of the tray 30 may be connected to the lever 34 by a gear. The lever 34 may be connected to the first gear 352, and the rotating shaft 301 may be connected to the second gear 353 engaged with the first gear 352. When the lever 34 is tilted, the tray 30 may be rotated by a rotational force transmitted thereto through the first gear 352, the second gear 353, and the rotating shaft 301.

Although an embodiment in which the lever 34 and the tray 30 are connected by a gear has been described above, a connection structure of the lever 34 and the tray 30 is not limited to that which is described above.

When the lever 34 is tilted in one direction, the tray 30 may be tilted in the other direction. When the tray 30 rotates by a predetermined angle in the other direction, the interfering protrusion 302 disposed at the one side surface of the tray 30 may interfere with the stopper 315. The one side of the tray 30 may stop rotating when the interfering protrusion 302 interferes with the stopper 315, and the other side of the tray 30 may further rotate in the other direction when the lever 34 is further tilted in the one direction. Since rotation angles of the one side and the other side of the tray 30 are different, a shape of the tray 30 may be twisted, and ice accommodated in the tray 30 may be separated from the tray 30.

The tray 30 may be detached from the first frame 31 by detaching the rotating shafts 301*a* and 301 from the mount 314 and the second gear 353, respectively. The user may easily detach the tray 30 from the first frame 31 when the tray 30 needs to be cleaned and sanitarily manage the tray 30.

Ice separated from the tray 30 may fall and be accommodated in the basket unit 4 disposed below the ice maker unit 3. Hereinafter, a structure of the basket unit 4 will be described in detail with reference to the drawings.

Figure 16:
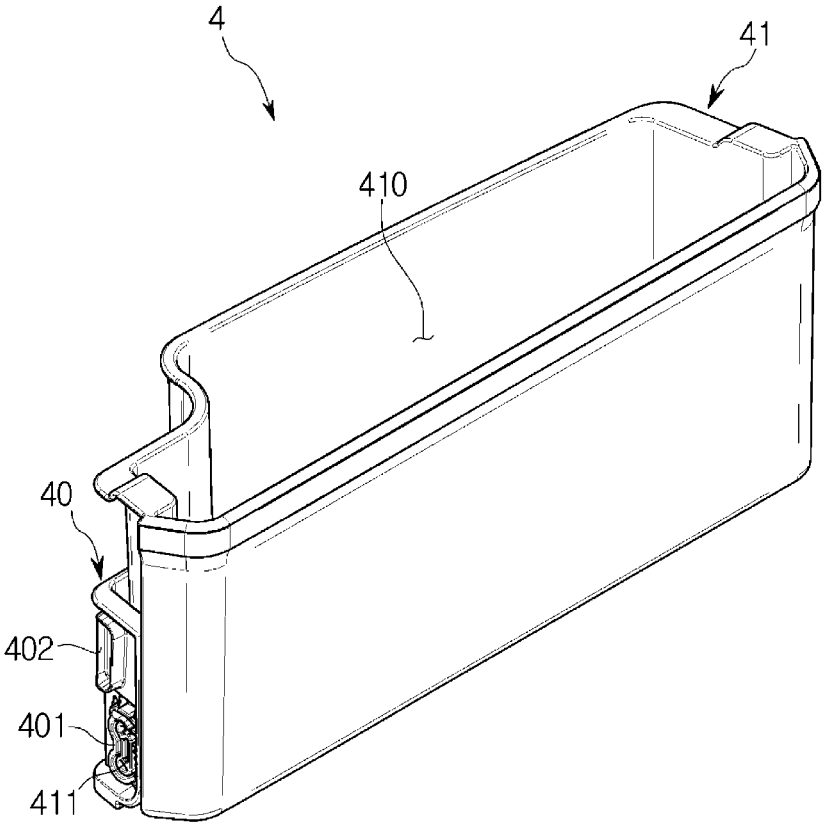
FIG. 16 illustrates a view for a basket unit according to various embodiments of the present disclosure.
Figure 17:
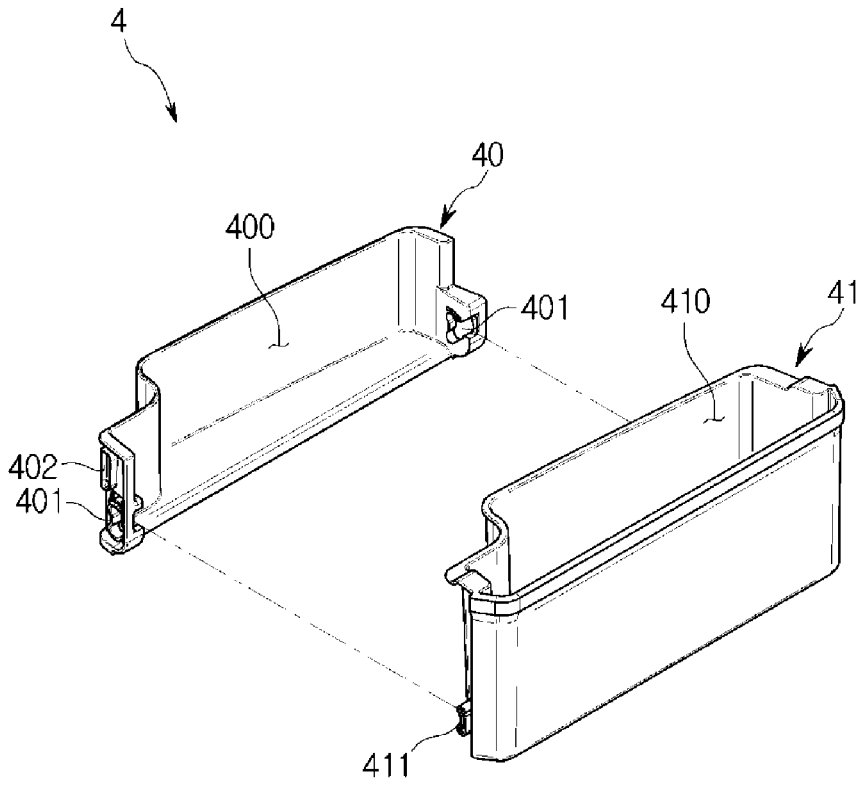
FIG. 17 illustrates an exploded perspective view for the basket unit according to various embodiments of the present disclosure.
Figure 18:
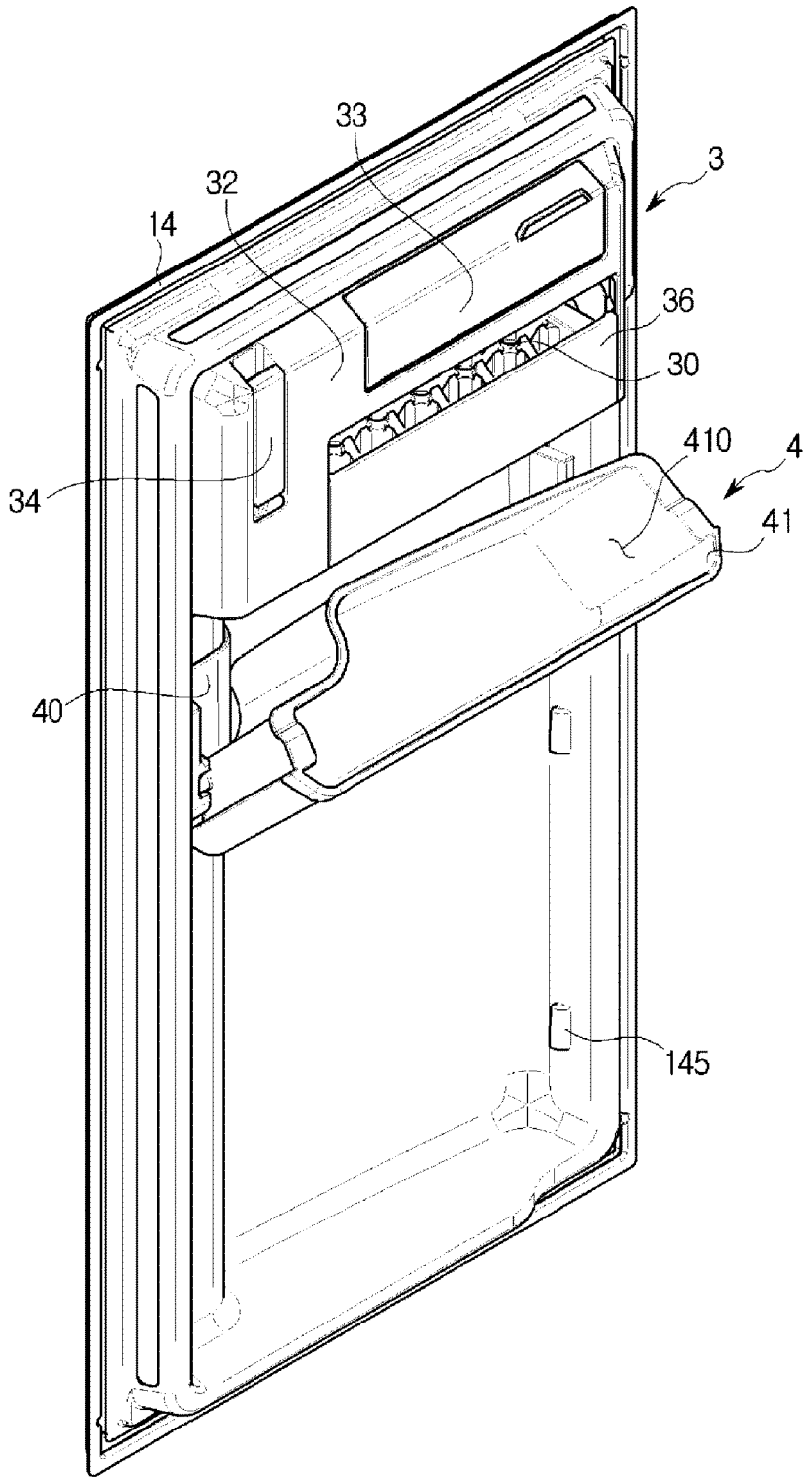
FIG. 18 illustrates a view for a state in which a basket is tilted according to various embodiments of the present disclosure.
Figure 19:
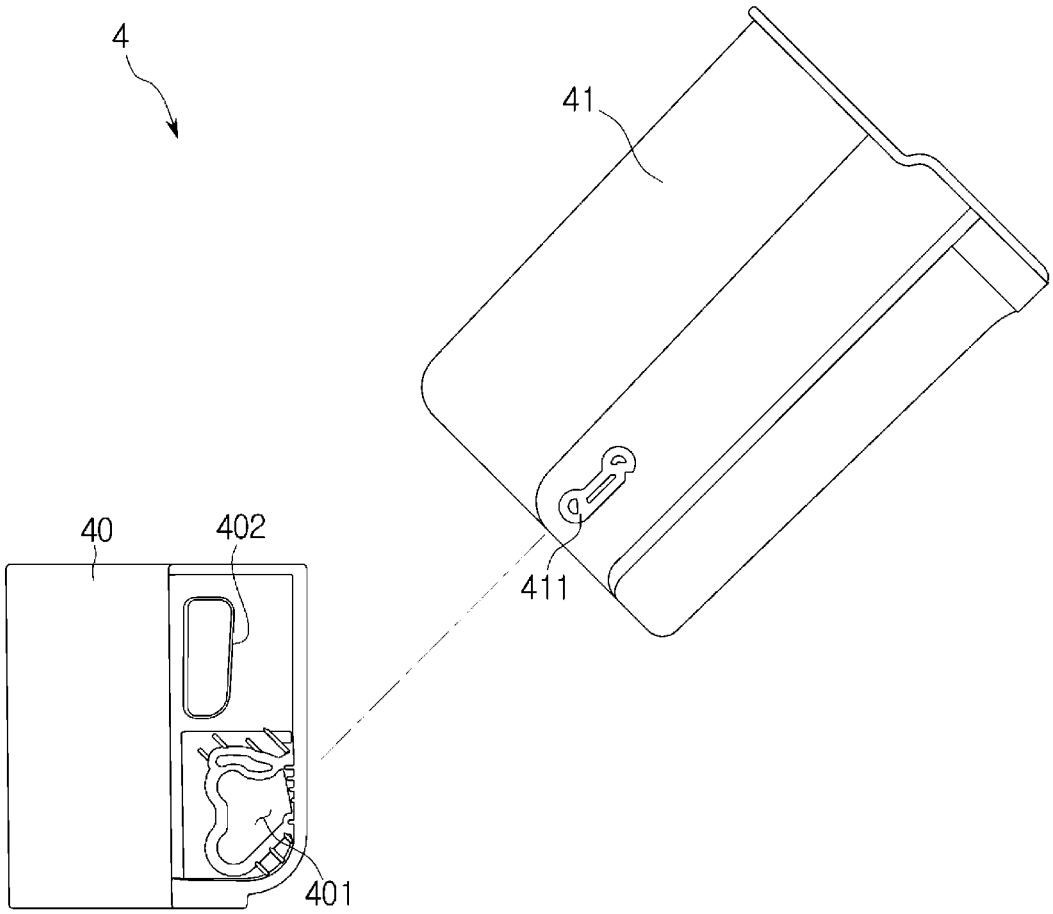
FIG. 19 illustrates a lateral view of the basket and a frame according to various embodiments of the present disclosure.

FIG. 16 illustrates a view for a basket unit according to various embodiments, FIG. 17 illustrates an exploded perspective view for the basket unit according to various embodiments, FIG. 18 illustrates a view for a state in which a basket is tilted according to various embodiments, and FIG. 19 illustrates a lateral view of the basket and a frame according to various embodiments.

Referring to FIGS. 16 to 19, the basket unit 4, according to various embodiments, may include a frame 40 mounted at the fourth door 14 and a basket 41 mounted at the frame 40. The basket 41 may include a storage 410 which is a space configured to accommodate ice formed in the ice maker unit 3. The basket 41 may be mounted at the frame 40 and tilted. The user may tilt the basket 41 to withdraw ice stored inside the basket 41.

The frame 40 may be detachably mounted at the fourth door 14. The user may change a position of the basket unit 4 in consideration of space utilization of the second lower storage space 140 (refer to FIG. 2). That is, the user may place the basket unit 4 at the upper portion or the lower portion of the fourth door 14.

The plurality of mounting protrusions 145 spaced a predetermined distance apart in the vertical direction may be disposed at the inner surface of the fourth door 14. The interferer 402 that may interfere with the mounting protrusion 145 may be disposed at one or more side surfaces of the frame 40. The interferer 402 may protrude from a side surface of the frame 40. The user may make the interferer 402 interfere with the mounting protrusion 145 to mount the frame 40 at the inner surface of the fourth door 14. In addition, the user may release interference between the interferer 402 and the mounting protrusion 145 to detach the frame 40 from the inner surface of the fourth door 14.

The frame 40 may be disposed to surround a part of an outer surface of the basket 41. For example, the frame 40 may be disposed to surround a rear surface, at least a portion of a side surface, and at least a portion of a bottom surface of the basket 41. The frame 40 may include an accommodator 400 configured to accommodate the rear surface, at least a portion of the side surface, and at least a portion of the bottom surface of the basket 41. Since the basket 41 is accommodated in the accommodator 400, the basket 41 may be stably supported by the frame 40 and fixed to the inner surface of the fourth door 14.

The basket 41 may be detachably mounted at the frame 40. In addition, the basket 41 is disposed to be tiltable while being mounted at the frame 40. A guide protrusion 411 may be formed at the basket 41, and a mounting guide 401 configured to guide the guide protrusion 411 by having the guide protrusion 411 inserted therein may be disposed at the frame 40. The mounting guide 401 may be integrally injection-molded with the basket 41. The guide protrusion 411 may be integrally disposed with the frame 40.

Hereinafter, a structure in which the basket 41 and the frame 40 are tiltably coupled will be described.

Figure 20:
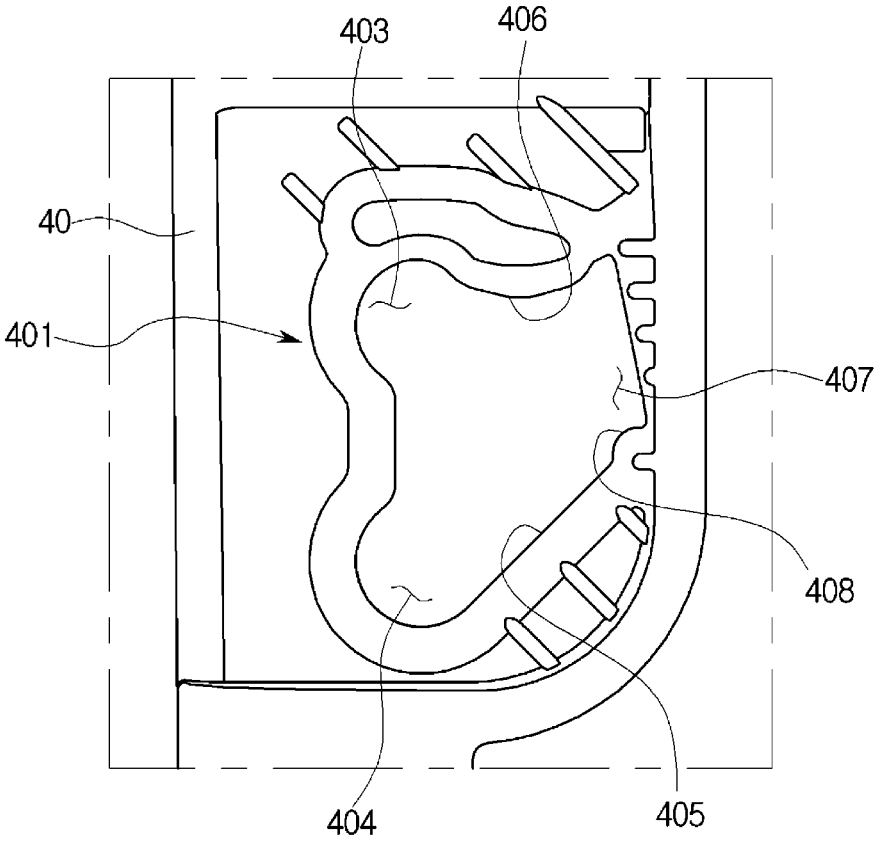
FIG. 20 illustrates a view for a guide disposed at the frame of the basket unit according to various embodiments of the present disclosure.
Figure 21:
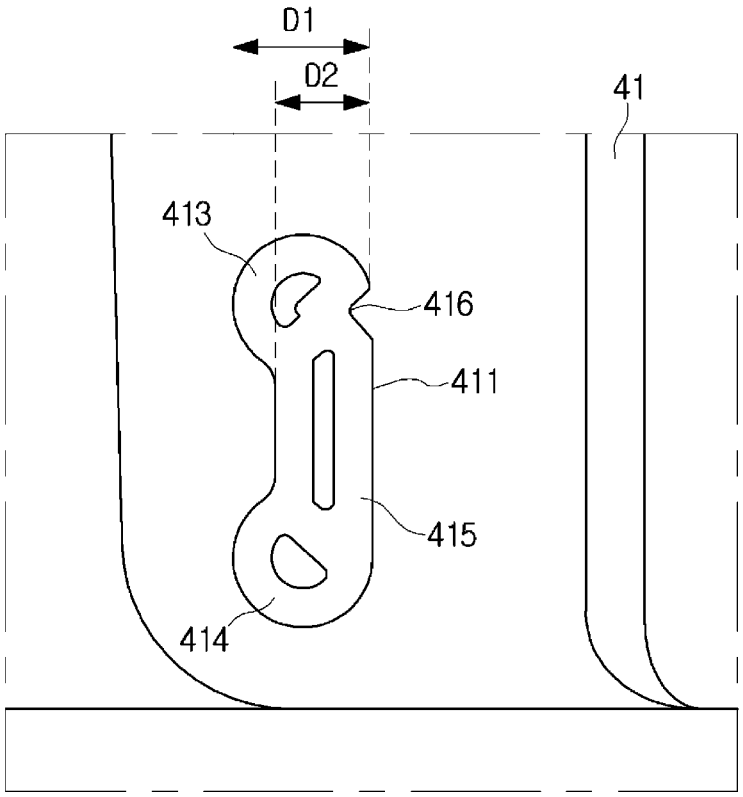
FIG. 21 illustrates a view for a tilting guide disposed at the basket according to various embodiments of the present disclosure.
Figure 22:
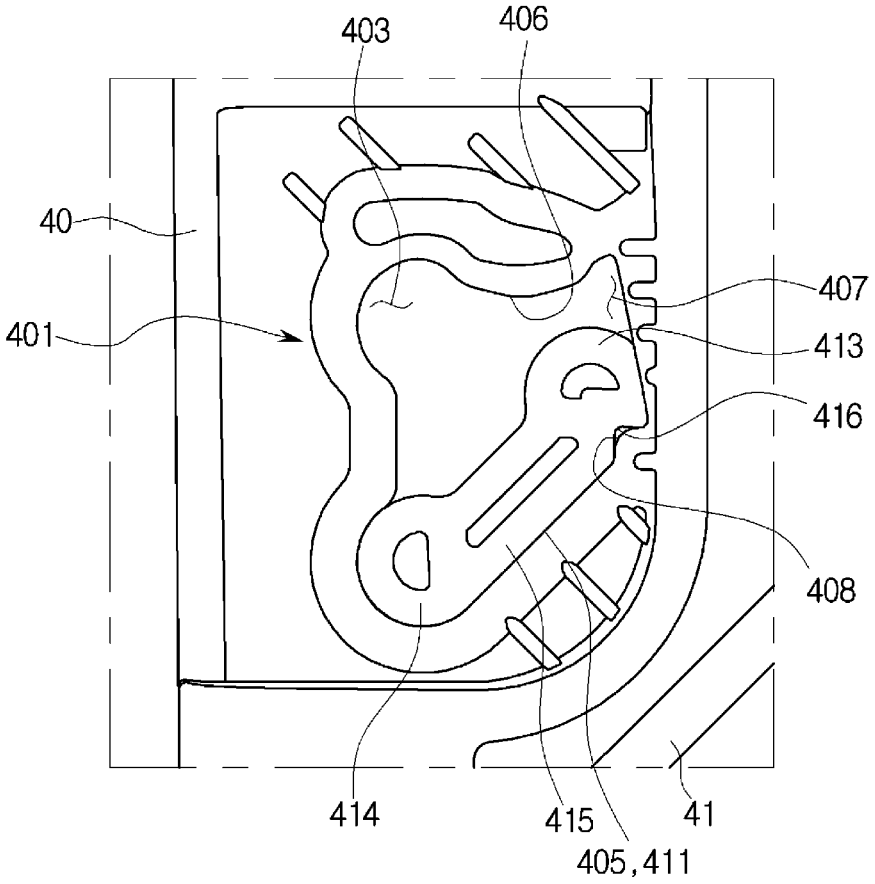
FIGS. 22 and 23 illustrates views for a state in which the tilting guide is guided by the guide according to various embodiments of the present disclosure.
Figure 23:
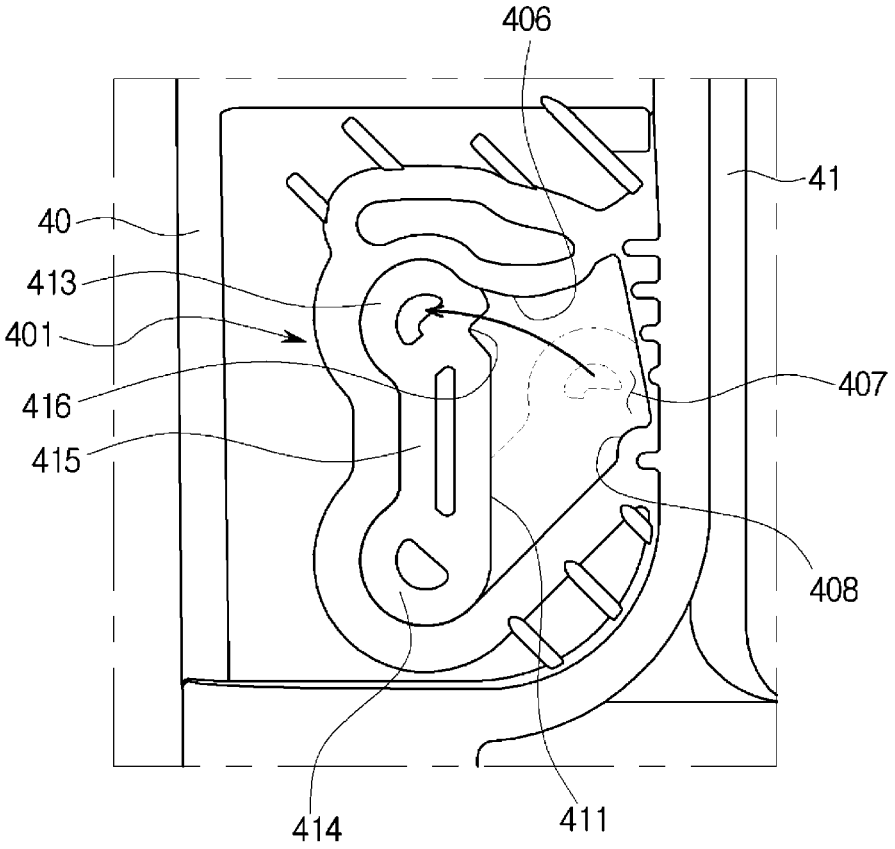

FIG. 20 illustrates a view for a guide disposed at the frame of the basket unit according to various embodiments, FIG. 21 illustrates a view for a tilting guide disposed at the basket according to various embodiments, and FIGS. 22 and 23 illustrate views for a state in which the tilting guide is guided by the guide according to various embodiments.

Referring to FIGS. 20 to 23, the guide protrusion 411 may protrude from the basket 41 according to various embodiments, and the mounting guide 401 configured to guide the guide protrusion 411 by having the guide protrusion 411 inserted therein may be disposed at the frame 40.

An inlet 407 of the mounting guide 401 through which the guide protrusion 411 enters and exits the mounting guide 401 may be disposed to be open. Since the inlet 407 of the mounting guide 401 being disposed to be open, the guide protrusion 411 may be easily inserted into the mounting guide 401 or leave the mounting guide 401. Also, the basket 41 may be detachably mounted at the frame 40.

The basket 41 may be mounted at the frame 40 while being tilted and may be detached from the frame 40 while being tilted.

The guide protrusion 411 may include a first guide 413 disposed at one end with respect to a connector 415 extending in a substantially straight line and a second guide 414 disposed at the other end. A diameter D1 of the first guide 413 and the second guide 414 may be formed larger than a width D2 of the connector 415.

A locking portion 416 may be concavely formed near the first guide 413.

The mounting guide 401 may include a first guide accommodator 403 configured to accommodate the first guide 413 and a second guide accommodator 404 configured to accommodate the second guide 414.

When the basket 41 is mounted at the frame 40 while being tilted, the second guide 414 may be disposed in the second guide accommodator 404. The connector 413 may be seated on a linear portion 405 disposed at a lower portion of the mounting guide 401.

The mounting guide 401 may include an interfering protrusion 408 configured to be inserted into the locking portion 416. The interfering protrusion 408 may protrude toward an inner portion of the mounting guide 401.

The interfering protrusion 408 may be inserted into the locking portion 416 while the basket 41 is tilted. Since the locking portion 416 interferes with the interfering protrusion 408 as described above, the basket 41 may remain tilted by a predetermined angle, and the guide protrusion 411 may not easily leave the mounting guide 401.

When the basket 41 tilted in one direction is tilted in the other direction, the mounting guide 401 may rotate in the other direction about the second guide 414, and the first guide 413 may be disposed in the first guide accommodator 403. The first guide 413 may pass through a rotation limiter 406 formed convexly downward while rotating in the other direction. The rotation limiter 406 may be formed convexly downward to have a lower height than the first guide accommodator 403. The rotation limiter 406 may be disposed to have tension such that the first guide 403 may easily pass through the rotation limiter 406 by an external force.

When the first guide 413 is disposed in the first guide accommodator 403, the first guide 413 may interfere with the rotation limiter 406 and remain disposed in the first guide accommodator 403 as long as an external force is not applied thereto. In this way, when the basket 41 is closed, the basket 41 may be prevented from freely opening as long as an external force is not applied thereto.

As described above, the user may easily withdraw ice by tilting the basket 41. Since additional elements other than the basket 41 and the frame 40 are not required to enable the basket 41 to be tiltably disposed, manufacturing costs for producing additional elements may be saved. Also, since a process for assembling additionally required parts may be omitted, production efficiency may be improved.

Also, since the basket 41 is detachably disposed at the frame 40, the user may easily detach the basket 41 from the frame 40 to clean the basket 41 as necessary. Thus, the basket 41 may be sanitarily managed.

Figure 24:
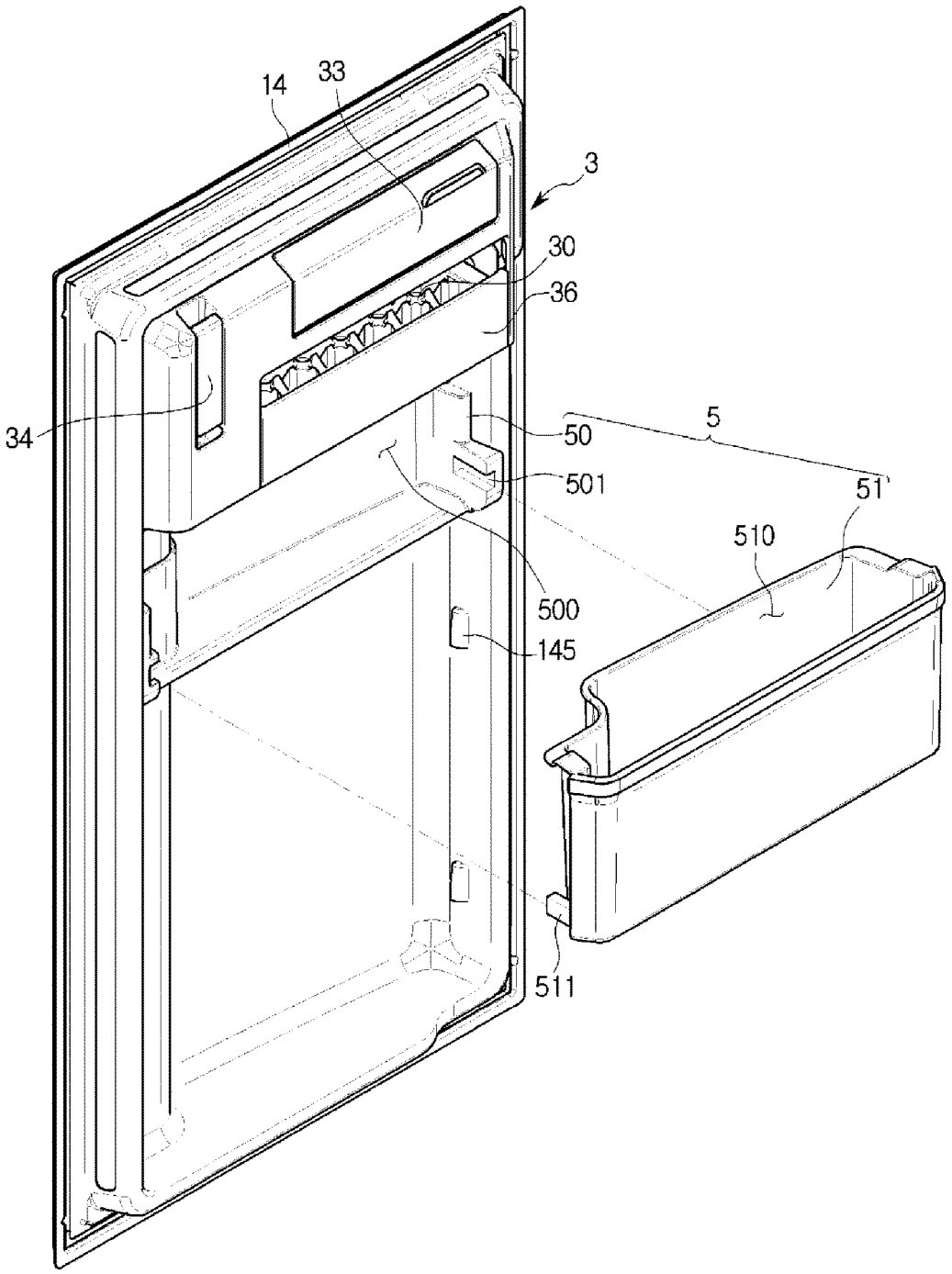
FIG. 24 illustrates as view for a basket unit according to various embodiments of the present disclosure.

FIG. 24 illustrates as view for a basket unit according to various embodiments.

Referring to FIG. 24, a basket unit 5 according to another embodiment may include a frame 50 and a basket 51. The basket 51 may be drawably disposed as a drawer. The basket 51 may include a storage 510 which is a space configured to accommodate ice formed in the ice maker unit 3. The ice maker unit illustrated in FIG. 24 may be the same as the ice maker unit 3 illustrated in FIGS. 4 to 15.

The frame 50 may include an accommodator 500 configured to accommodate the basket 51. An interferer configured to interfere with a mounting protrusion protruding from a refrigerator door may be disposed at an outer surface of the frame 50. The frame 50 may be mounted at the refrigerator door by the interferer interfering with the mounting protrusion.

A rail 501 configured to guide movement of the basket 51 may be disposed at an inner surface of the frame 50. The rail 501 may be disposed to extend from a front portion of the frame 50 toward a rear portion thereof. A slider 511 configured to move along the rail 501 may be disposed at an outer surface of the basket 51. A roller may be disposed at the outer surface of the basket 51 to enable the slider 511 to smoothly slide along the rail 501.

Figure 25:
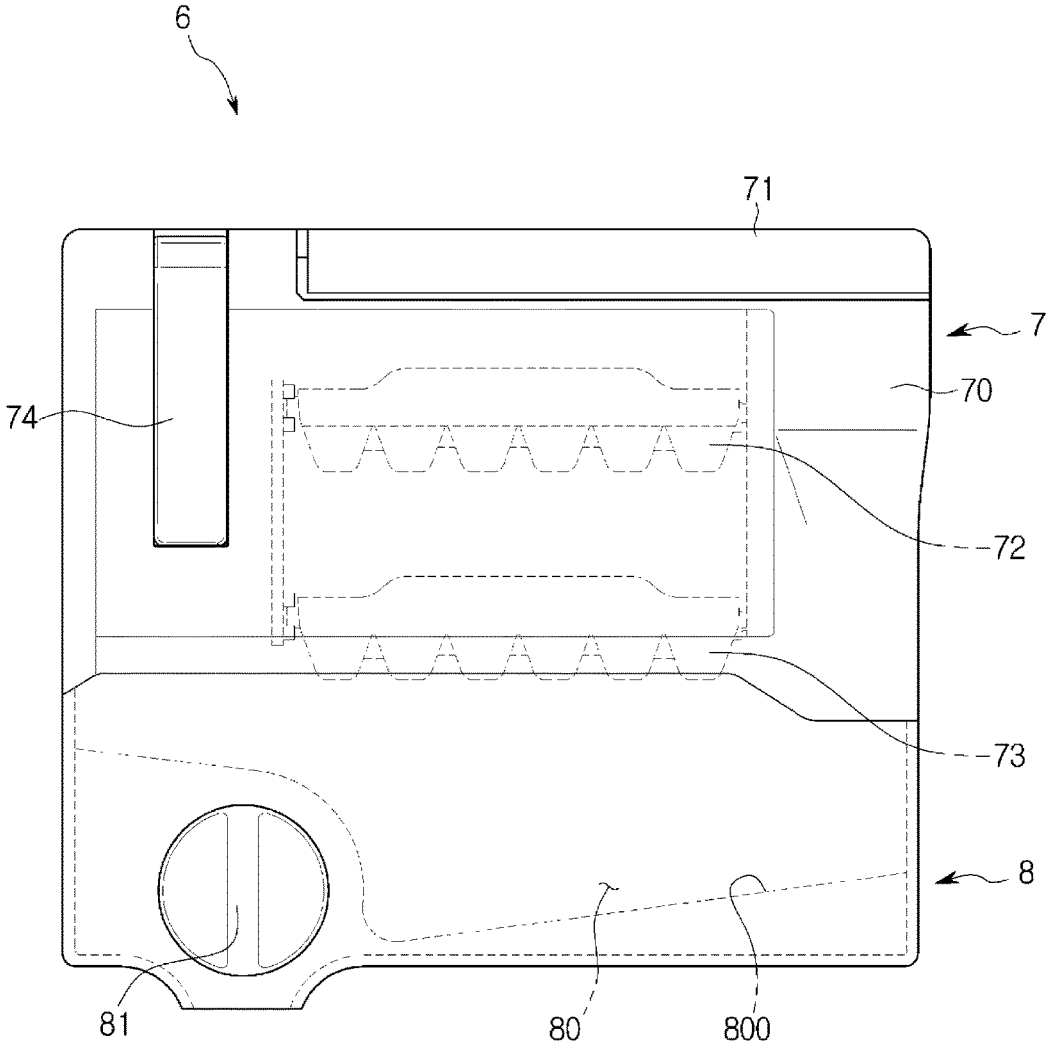
FIG. 25 illustrates a view for an ice maker assembly according to various embodiments of the present disclosure.
Figure 26:
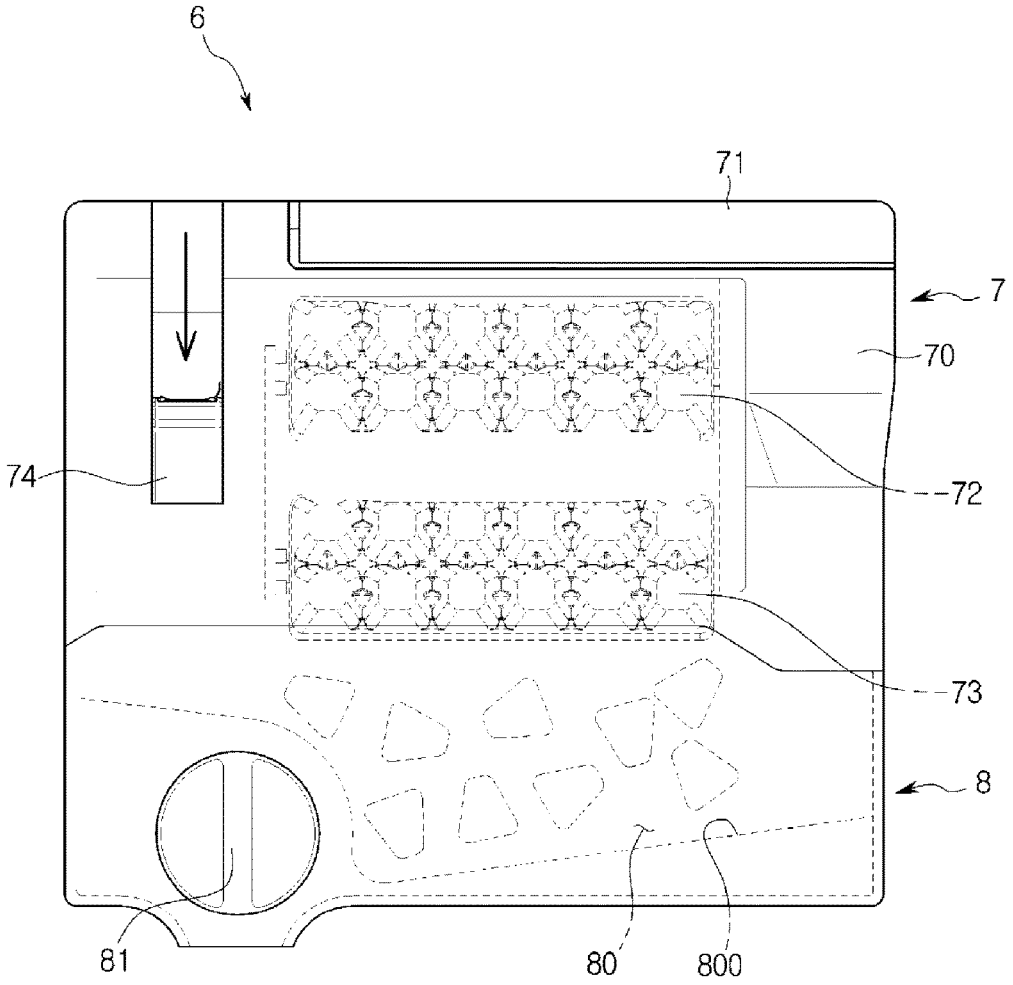
FIG. 26 illustrates a view for a state in which a tray is rotated in the ice maker assembly according to various embodiments of the present disclosure.
Figure 27:
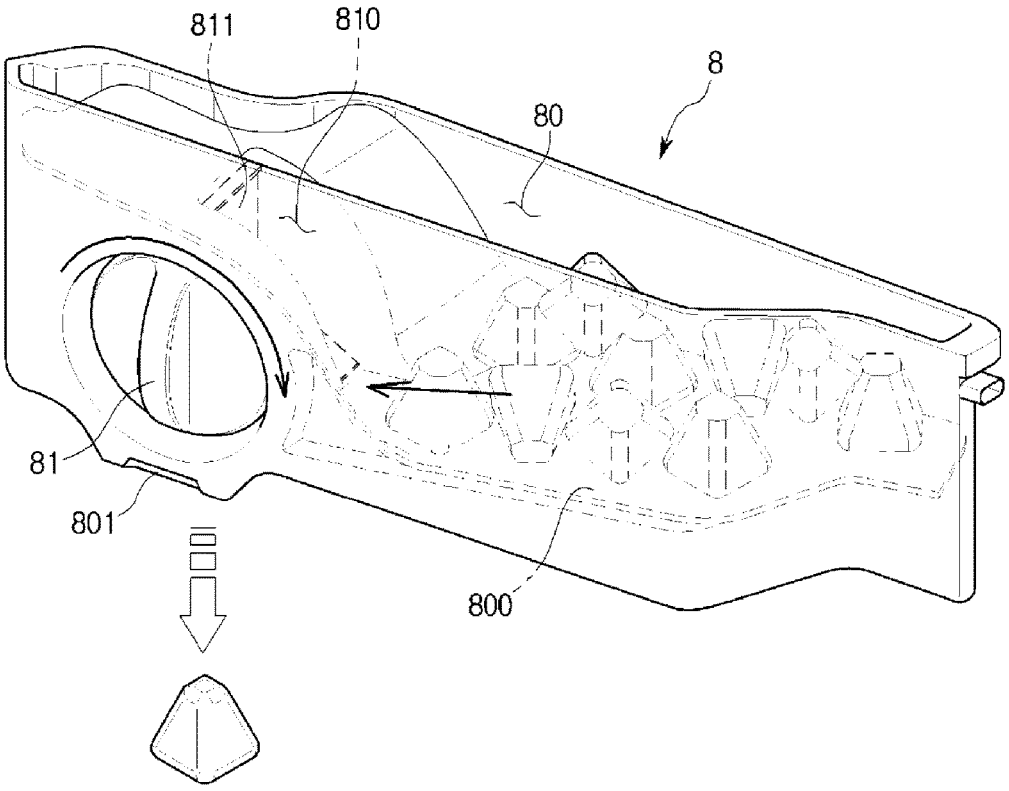
FIG. 27 illustrates a view for a basket unit according to various embodiments of the present disclosure.

FIG. 25 illustrates a view for an ice maker assembly according to various embodiments, FIG. 26 illustrates a view for a state in which a tray is rotated in the ice maker assembly according to various embodiments, and FIG. 27 illustrates a view for a basket unit according to various embodiments.

Referring to FIGS. 25 to 27, an ice maker assembly 6, according to various embodiments, may include an ice maker unit 7 configured to form ice and a basket unit 8 configured to store ice formed in the ice maker unit 7.

A plurality of trays 72 and 73 in which ice is formed may be disposed in the ice maker unit 7. For example, the trays 72 and 73 may include a first tray 72 and a second tray 73 disposed below the first tray 72.

The trays 72 and 73 may be rotatably mounted at a frame 70 disposed in the ice maker unit 7. The plurality of trays 72 and 73 may be disposed in the vertical direction. Since the plurality of trays 72 and 73 are disposed in the ice maker unit 7, a large amount of ice may be formed per unit hour.

The ice maker unit 7 may include a lever 74 disposed to be tiltable, and the trays 72 and 73 may be rotated by the lever 74. When the trays 72 and 73 are rotated by a predetermined angle and the lever 74 is further tilted, shapes of the trays 72 and 73 are twisted, and ice formed in the trays 72 and 73 may be separated from the trays 72 and 73.

Configurations illustrated in FIGS. 3 to 15 may be similarly applied to a configuration for twisting the shapes of the trays 72 and 73.

Ice separated from the trays 72 and 73 may fall and be stored in the basket unit 8 disposed below the ice maker unit 7. The basket unit 8 may include a lever 81 disposed to be rotatable. When the lever 81 is rotated, ice stored in a storage 80 formed inside the basket unit 8 may be withdrawn.

A user may rotate the lever 81 to withdraw a desired amount of ice. For example, when the user attempts to withdraw a large amount of ice, the user may rotate the lever 81 a larger number of times than when the user attempts to withdraw a small amount of ice.

A plurality of blades 811 may be connected to the lever 81. The plurality of blades 811 may be disposed in the storage 80. The plurality of blades 811 may be disposed to extend outward from a central portion (not illustrated) extending from the center of the lever 81. A predetermined amount of ice may be accommodated in an accommodator 810 provided between adjacent blades 811. When the lever 81 is rotated, ice accommodated in the accommodator 810 may be discharged through an outlet 712.

The user may rotate the lever 81 until a desired amount of ice is withdrawn. In this way, the user may easily withdraw ice using the lever 81 without a separate tool. Also, since the user does not have to directly withdraw ice by hand, ice may be sanitarily withdrawn.

A bottom surface 800 of the storage 80 may be gradually inclined downward toward the accommodator 810 such that ice may be easily accommodated in the accommodator 810. Ice separated and falling from the trays 72 and 73 may move along the inclined bottom surface 800 to move toward the accommodator 810. An adequate amount of ice may be accommodated in the accommodator 810, and a predetermined amount of ice may be withdrawn according to a degree to which the user rotates the lever 81.

A water tank 71 configured to supply water to the trays 72 and 73 may be disposed above the trays 72 and 73. The water tank 71 may be detachably mounted at the frame 70.

Hereinafter, a structure which supplies water stored in the water tank 71 to the plurality of trays 72 and 73 will be described.

Figure 28:
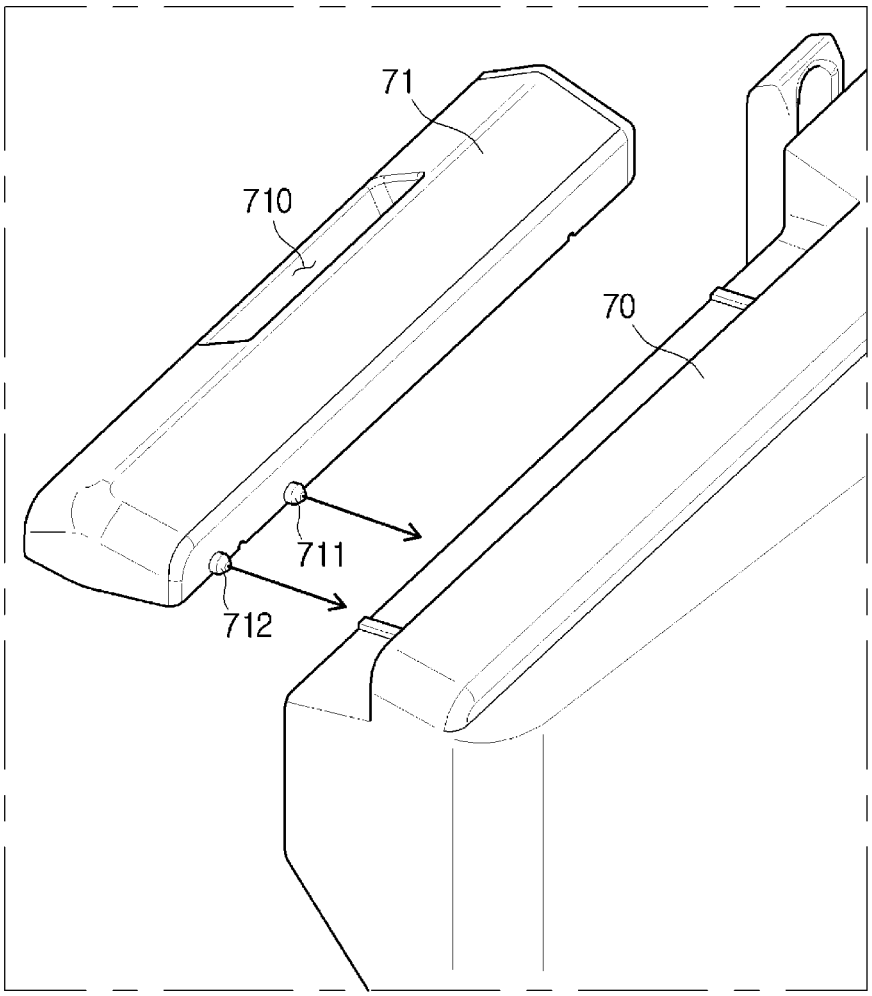
FIG. 28 illustrates a view for a water tank disposed in the ice maker unit according to various embodiments of the present disclosure.
Figure 29:
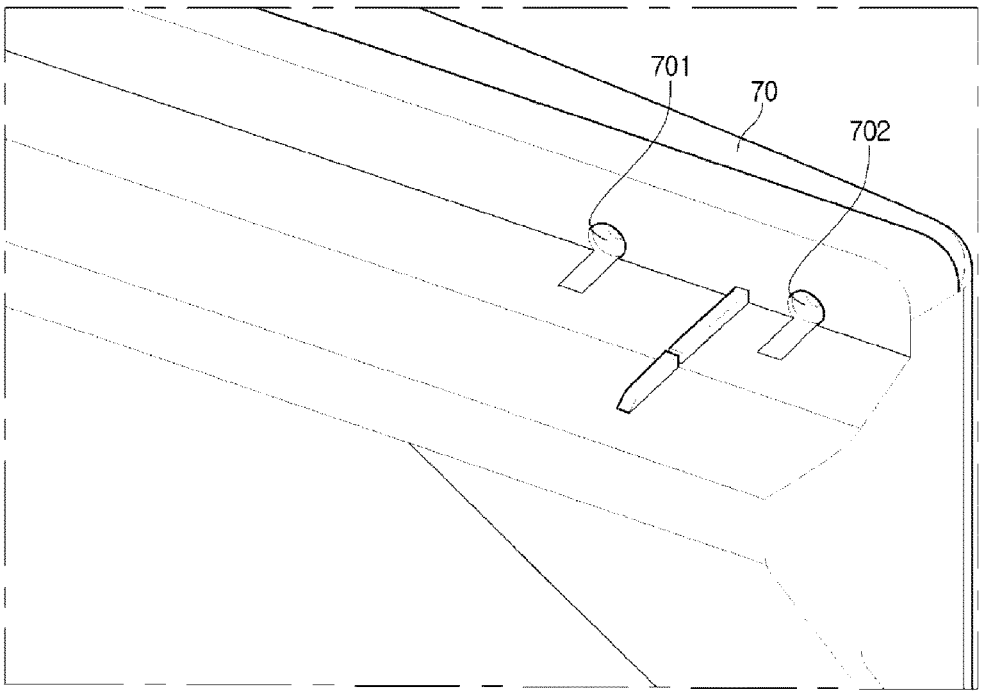
FIG. 29 illustrates a view for a portion of a frame disposed in the ice maker unit according to various embodiments of the present disclosure.
Figure 30:
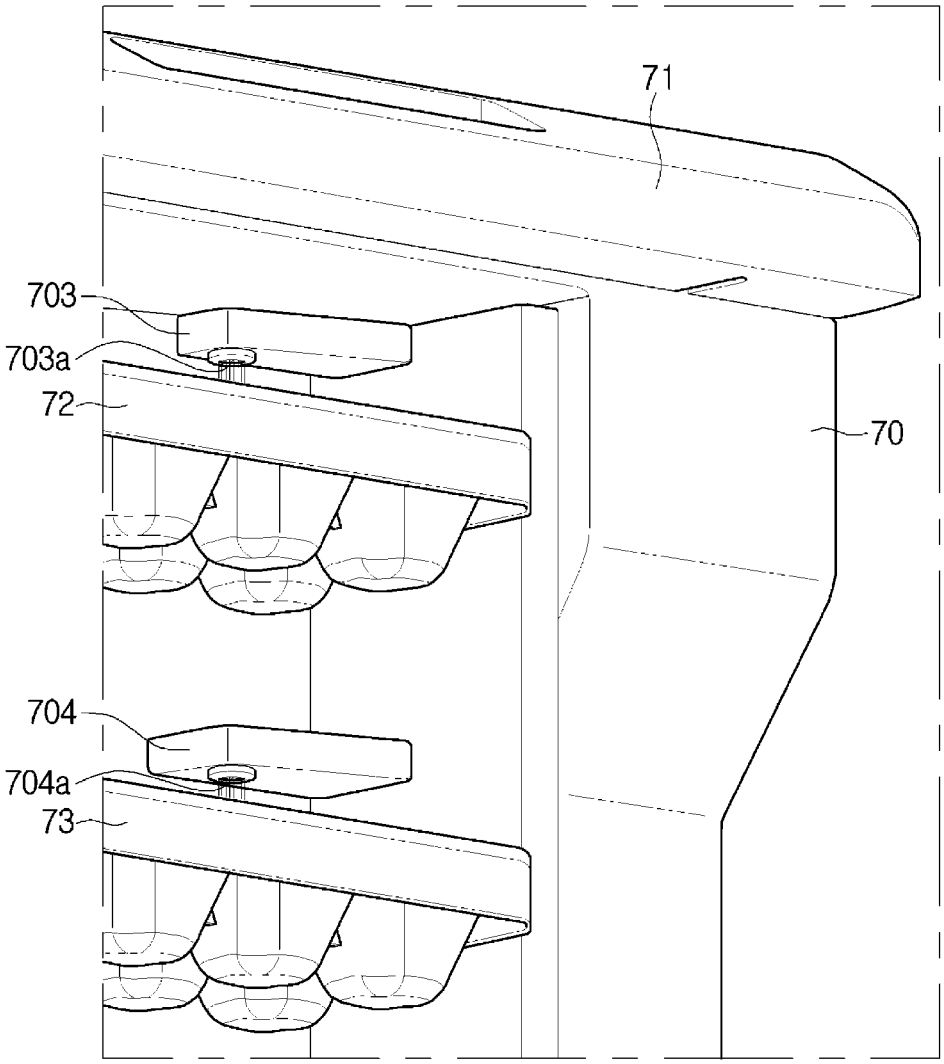
FIG. 30 illustrates a view for a portion of the ice maker unit according to various embodiments of the present disclosure.

FIG. 28 illustrates a view for a water tank disposed in the ice maker unit according to various embodiments, FIG. 29 illustrates a view for a portion of a frame disposed in the ice maker unit according to various embodiments, and FIG. 30 illustrates a view for a portion of the ice maker unit according to various embodiments.

Referring to FIGS. 28 to 30, the ice maker unit 7, according to various embodiments, may include the water tank 71 configured to supply water to the plurality of trays 72 and 73. The water tank 71 may be disposed above the trays 72 and 73.

The water tank 71 may be detachably mounted at the frame 70. The water tank 71 may include a handle 710 to enable a user to easily mount or detach the water tank 71 while holding the handle 710.

The water tank 71 may include a plurality of outlets 711 and 712. The frame 70 may include a plurality of inlets 701 and 702 disposed at positions corresponding to the plurality of outlets 711 and 712. For example, the water tank 71 may include a first outlet 711 and a second outlet 712 spaced a predetermined distance apart from the first outlet 711. The frame 70 may include a first inlet 701 corresponding to the first outlet 711 and a second inlet 702 corresponding to the second outlet 712.

When the water tank 71 is mounted at the frame 70, the first outlet 711 may communicate with the first inlet 801, and the second outlet 712 may communicate with the second inlet 702.

A flow channel extending from the first inlet 701 may be formed inside the frame 70. The flow channel extending from the first inlet 701 may extend above the first tray 72. A flow channel guide 703 connected to a flow channel extending from the frame 70 may be disposed above the first tray 72. An outlet 703*a* may be formed at a bottom surface of the flow channel guide 703, and water may be supplied to the first tray 72 through the outlet 703*a*.

A flow channel extending from the second inlet 702 may be formed inside the frame 70. The flow channel extending from the second inlet 702 may extend above the second tray 73. A flow channel guide 704 connected to a flow channel extending from the frame 70 may be disposed above the second tray 73. An outlet 704*a* may be formed at a bottom surface of the flow channel guide 704, and water may be supplied to the second tray 73 through the outlet 704*a*.

In this way, water stored in the water tank 71 may be supplied to the plurality of trays 72 and 73 stacked in the vertical direction through flow channels formed in the frame 70.

According to an ice maker assembly and a refrigerator having the same according to an embodiment, the ice maker assembly is movably installed in a freezer compartment such that a space inside the freezer compartment can be efficiently utilized.

Further, since water can be supplied to a tray without the tray being detached, usage is convenient.

Further, a water tank, the tray, and an ice basket are disposed to be detachable such that cleaning is facilitated.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An ice maker assembly disposed in a storage space of a refrigerator to form ice, the ice maker assembly comprising:

an ice maker unit configured to form ice, including:

a frame mounted at the refrigerator and including a guide;

a tray mounted at the frame and comprising a space in which the ice is formed;

a water tank tiltably mounted at the frame, configured to supply water to the tray, and including a rotating protrusion configured to be inserted into the guide, the rotating protrusion defining an axis about which the water tank is tilted; and a basket unit configured to store the ice formed in the ice maker unit;

wherein:

water stored in the water tank is supplied to the tray when the water tank is tilted in a first direction, and when the water tank is tilted in a second direction opposite to the first direction, the water tank is opened to receive water.

2. The ice maker assembly of claim 1, wherein the water tank is disposed to be detachable from the frame.

3. The ice maker assembly of claim 1, wherein the rotating protrusion is integrally formed with the water tank.

4. The ice maker assembly of claim 1, wherein:

a guide protrusion configured to guide a tilting motion of the water tank is disposed at a side surface of the water tank, and the guide is further configured to guide movement of the guide protrusion is disposed at the frame.

5. The ice maker assembly of claim 4, wherein the guide includes a first accommodator configured such that the guide protrusion is movably inserted therein and a second accommodator configured such that a rotating protrusion is disposed at a side surface of the water tank inserted therein, and the guide protrusion moves along the first accommodator when the rotating protrusion rotates in the second accommodator.

6. The ice maker assembly of claim 5, wherein one side of the first accommodator and one side of the second accommodator are open to enable the guide protrusion accommodated in the first accommodator and the rotating protrusion accommodated in the second accommodator to leave the first accommodator and the second accommodator, respectively.

7. The ice maker assembly of claim 5, wherein the first accommodator includes a lock configured to interfere with the guide protrusion when the water tank is tilted in the first direction and opened to keep the water tank tilted in the first direction.

8. The ice maker assembly of claim 5, wherein the first accommodator includes a seat configured to interfere with the guide protrusion when the water tank is tilted in another direction and closed to prevent the water tank from freely opening.

9. The ice maker assembly of claim 8, wherein the seat is provided by a part of a first seating portion on which the guide protrusion is movably seated convexly formed upward.

10. The ice maker assembly of claim 1, wherein the frame includes a lever connected to the tray and configured to be tiltable, and the tray rotates about a rotating shaft when the lever is tilted.

11. The ice maker assembly of claim 1, wherein the basket unit includes a second frame and a basket detachably disposed at the second frame, and the basket is tiltably mounted at the second frame.

12. The ice maker assembly of claim 11, wherein a second guide protrusion protrudes from a side surface of the basket, and the second frame includes a second guide configured to guide the second guide protrusion by the second guide protrusion being inserted therein.

13. The ice maker assembly of claim 12, wherein one side of the second guide is open to enable the second guide protrusion to leave the second guide.

14. The ice maker assembly of claim 12, wherein the second guide includes an interfering protrusion, the second guide protrusion includes a lock configured such that the interfering protrusion is inserted therein, and the interfering protrusion is inserted into the lock when the basket is mounted at the second frame and tilted in the first direction to keep the basket tilted.

15. The ice maker assembly of claim 14, wherein one side of the interfering protrusion interferes with a rotation limiter disposed at the second guide when the basket is tilted in another direction to fix the basket to prevent the basket from moving in the first direction.

16. A refrigerator comprising:

a main body configured to form a storage space therein;

a door mounted at the main body and configured to open and close the storage space;

an ice maker unit detachably mounted at the door and configured to form ice, the ice maker unit comprising:

a frame mounted at the refrigerator and including a guide, a tray comprising a space in which the ice is formed, and a water tank configured to be tilted to supply water to the tray when the water tank is tilted in a first direction and including a rotating protrusion configured to be inserted into the guide, the rotating protrusion defining an axis about which the water tank is tilted, and a basket unit detachably mounted at the door and configured to store the ice formed in the ice maker unit, wherein when the water tank is tilted in a second direction opposite to the first direction, the water tank is opened to receive water.

17. The refrigerator of claim 16, wherein a plurality of mounting protrusions are disposed at an inner surface of the door, the plurality of mounting protrusions are spaced apart from one another in a vertical direction, and interferers configured to interfere with the plurality of mounting protrusions are disposed at a side surface of the ice maker unit and a side surface of the basket unit.

18. The refrigerator of claim 17, wherein positions at which the ice maker unit and the basket unit are mounted at the door are changeable in the vertical direction.

19. The refrigerator of claim 16, wherein the ice maker unit includes a frame detachably mounted at the door, and the water tank and the tray are tiltably mounted at the frame.

20. The refrigerator of claim 19, wherein the frame includes an accommodator configured to accommodate water supplied from the water tank, a hole through which water is discharged is formed at a bottom surface of the accommodator, and the bottom surface is inclined to enable water introduced into the accommodator to flow toward the hole.

* * * * *